US005591570A

United States Patent [19]

Takiguchi et al.

[11] Patent Number: 5,591,570

[45] Date of Patent: Jan. 7, 1997

[54] LIGHT-SENSITIVE SILVER HALIDE PHOTOGRAPHIC EMULSION, SILVER HALIDE PHOTOGRAPHIC LIGHT SENSITIVE MATERIAL AND METHOD FOR PROCESSING SILVER HALIDE PHOTOGRAPHIC LIGHT-SENSITIVE MATERIAL

[75] Inventors: Hideki Takiguchi; Hiroshi Kashiwagi; Nobuaki Tsuji; Hó Socman; Katsuhiko Heki, all of Hino, Japan

[73] Assignee: Konica Corporation, Japan

[21] Appl. No.: 545,888

[22] Filed: Oct. 20, 1995

Related U.S. Application Data

[63] Continuation of Ser. No. 273,708, Jul. 12, 1994, abandoned.

[30] Foreign Application Priority Data

Jul. 15, 1993 [JP] Japan ..... 5-175617
Aug. 20, 1993 [JP] Japan ..... 5-206601

[51] Int. Cl.[6] ..... G03C 1/035; G03C 1/12

[52] U.S. Cl. ..... 430/567; 430/570; 430/574; 430/588

[58] Field of Search ..... 430/567, 570, 430/574, 588

[56] References Cited

U.S. PATENT DOCUMENTS

| | | | |
|---|---|---|---|
| 4,555,481 | 11/1985 | Ukai et al. | 430/588 |
| 5,057,409 | 10/1991 | Suga | 430/567 |
| 5,147,771 | 9/1992 | Tsaur et al. | 430/569 |
| 5,147,773 | 9/1992 | Tsaur et al. | 430/569 |
| 5,171,659 | 12/1992 | Tsaur et al. | 430/569 |
| 5,330,887 | 7/1994 | Hasebe et al. | 430/588 |

FOREIGN PATENT DOCUMENTS

| | | | |
|---|---|---|---|
| 273411 | 7/1988 | European Pat. Off. | G03C 1/02 |
| 531052 | 3/1993 | European Pat. Off. | G03C 1/005 |
| 543319 | 5/1993 | European Pat. Off. | G03C 7/30 |
| 547912 | 6/1993 | European Pat. Off. | G03C 1/005 |
| 5-297496 | 11/1993 | Japan . | |

OTHER PUBLICATIONS

Meier, H. "Spectral Sensitization", Focal Press, London, 1968, p. 74.

*Primary Examiner*—Janet C. Baxter
*Attorney, Agent, or Firm*—Jordan B. Bierman; Bierman and Muserlian

[57] ABSTRACT

A light-sensitive silver halide photographic emulsion is disclosed, wherein at least 70% of the total projected area of silver halide grains are tabular grains having an average aspect ratio of a diameter to a thickness of 2 or more, an average value of the longest distances between two or more parallel twin planes contained in the respective tabular grains is 0.008 μm or more, and a variation coefficient of the longest distances between parallel twin planes is 35% or less, and wherein the silver halide emulsion is spectrally sensitized with a substantially slightly water-soluble sensitizing dye by adding the dye to the emulsion in the form of a dispersion of solid particles dispersed in an aqueous solution substantially free from an organic solvent or surfactant.

7 Claims, No Drawings

LIGHT-SENSITIVE SILVER HALIDE PHOTOGRAPHIC EMULSION, SILVER HALIDE PHOTOGRAPHIC LIGHT SENSITIVE MATERIAL AND METHOD FOR PROCESSING SILVER HALIDE PHOTOGRAPHIC LIGHT-SENSITIVE MATERIAL

This application is a continuation of application Ser. No. 08/273,708, filed Jul. 12, 1994, now abandoned.

FIELD OF THE INVENTION

The present invention relates to a tabular light-sensitive silver halide photographic emulsion, a silver halide photographic light-sensitive material using said emulsion, especially a medical radiographic silver halide photographic light-sensitive material, and a method for processing said light-sensitive material. More specifically, the present invention relates to a tabular light-sensitive silver halide photographic emulsion having high sensitivity and excellent properties such as low residual coloring, high image sharpness and high pressure resistance, a silver halide photographic light-sensitive material using said emulsion, and a method for processing said light-sensitive material.

BACKGROUND OF THE INVENTION

Increasing the sensitivity of light-sensitive silver halide photographic emulsions is the most effective means of improving various characteristics of photographic light-sensitive materials. For example, high-speed color photographic light-sensitive materials currently used have been realized by increasing the sensitivity of photographic emulsions. With respect to image quality, it is also well known that graininess can be improved by the use of smaller silver halide grains with an enhanced sensitivity. Further, in the manufacture of radiographic light-sensitive materials, a technique for improving the sensitivity of light-sensitive silver halide photographic emulsions is not dispensable for securing a desired sensitivity with the sharpness kept high by cutting down crossover light. Therefore, various studies have so far been made in the industry for the purpose of raising the sensitivity of light-sensitive silver halide photographic emulsions.

In recent years, there are disclosed a variety of techniques which use tabular silver halide grains for the purpose of raising the sensitivity, and examples thereof can be seen in Japanese Pat. O.P.I. Pub. Nos. 111935/1983, 111936/1983, 111937/1983, 113927/1983, 99433/1984, etc.

Further, Japanese Pat. O.P.I. Pub. No. 92942/1988 discloses a technique to provide cores of high silver iodide content inside tabular silver halide grains, and Japanese Pat. O.P.I. Pub. No. 151618/1988 discloses a technique which uses hexagonal tabular silver halide grains; favorable results are reported on both the techniques.

Furthermore, techniques relating to the composition distribution of tabular silver halide grains are disclosed in Japanese Pat. O.P.I. Pub. Nos. 106746/1988, 183644/1989 and 279237/1989. With respect to the crystal structure of tabular silver halide grains, there are disclosed several techniques which relate to the form or parallel twin planes of tabular grains. For example, Japanese Pat. O.P.I. Pub. No. 131541/1989 discloses a technique to improve the sensitivity and graininess by use of discoidal grains.

Japanese Pat. O.P.I. Pub. No. discloses a technique using tabular silver halide grains having two or more parallel twin planes in which the ratio of intertwin-plane distance between parallel twin planes (a) to grain thickness (b), or (b/a), is 5 or more and describes the effect on the sensitivity and graininess; particularly, a technique to increase the uniformity of intertwin-plane distances of grains, and the enhancement in sensitivity and the improvement in graininess thereby attained are described.

Wo No. 91/18320 discloses a technique using tabular silver halide grains whose intertwin-plane distances (a) are 0.012 μm or less and describes that a desirable high sensitivity has been attained by this technique.

EP No. 515894A1 discloses the achievement of high sensitivity by making the percentage of (111) faces in side-face of silver halide grains, having a tabularity given by (grain diameter)/(grain thickness)$^2$ of 25 or more, 75% or less.

On the other hand, there have been disclosed various techniques to eliminate the defects of tabular silver halide grains. For example, Japanese Pat. O.P.I. Pub. No. 142439/1991 discloses a technique for improving the preservability under highly humid conditions by use of an emulsion in which 50% or more of the total projected area comes from tabular grains having an aspect ratio of 3 or more and having (111) faces and (100) faces.

Since these tabular silver halide grains are larger in surface area than silver halide regular crystal grains, such as hexahedral or octahedral crystal grains, when compared in the same volume, sensitizing dyes can be adsorbed in larger amounts on the surfaces of these grains; therefore, it is thought that this brings about advantages of high sensitivity and high sharpness due to decreased scattered light.

However, even when the amount of a sensitizing dye is increased in proportion to the surface area of tabular grains, the sensitivity cannot be raised so much as expected in fact; further, stains attributable to residual dyes are liable to occur because of shortening of developing time. Furthermore, organic solvents and/or surfactants needed for adding dyes in large amounts are liable to cause troubles such as formation of precipitates in a silver halide photographic emulsion or coating failures including spots and streak lines in the process of coating emulsions. In addition, the use of organic solvents poses problems in operation and environmental protection.

In incorporating sparingly water-soluble photographic additives into a silver halide photographic emulsion, the usual method comprises the steps of dissolving a photographic additive in an organic solvent such as methanol and then adding the solution to a silver halide photographic emulsion. Instead of this conventional method, there are attempted in recent years to add an additive by the steps of dispersing the additive, without the aid of an organic solvent, in an aqueous system in the presence of a wetting agent and a dispersing agent and then adding the resultant aqueous dispersion to a silver halide photographic emulsion. For example, Japanese Pat. O.P.I. Pub. No. 110012/1977 discloses such a method, in which a sensitizing dye is ground in an aqueous phase in the presence of a dispersing agent (a surfactant) capable of providing a prescribed surface tension, the resultant aqueous dispersion is dewatered, dried and added to a silver halide emulsion as it is or after being dispersed in water or an aqueous solution of gelatin.

Japanese Pat. O.P.I. Pub. No. 102733/1978 discloses a method comprising the steps of preparing a uniform mixture (a paste-like mixture) containing a photographic fine particle additive, a dispersing agent such as sorbitol and a protective colloid such as gelatin, forming the mixture into noodles, drying them in warm air, followed by granulation. The resulting granules are added to a photographic aqueous colloid coating composition.

Further, U.S. Pat. No. 4,006,025 discloses a method in which a spectral sensitizer is mixed with water to form a slurry, the spectral sensitizer is uniformly dispersed in water by homogenizing or milling at a temperature of 40° to 50° C. in the presence of a surfactant, and then the dispersion so prepared is added to a silver halide photographic emulsion.

Any of them is a method of adding a photographic additive, such as a spectral sensitizer, by use of an aqueous system as a substitute for an organic solvent; but, these show the following disadvantages when put in practical use. Since an aqueous dispersion is made into powder by freeze drying or the like, it takes a long time to have an additive such as a spectral sensitizer adsorbed by silver halide grains; therefore, desired photographic sensitivities cannot be obtained in the usual sensitizing time and, moreover, coating failures attributable to deposits are liable to occur when such a silver halide photographic emulsion is used in coating. Further, a wetting agent and a dispersing agent used in dispersing the additive produce undesired effects such as break of emulsified matters contained in a silver halide photographic emulsion, increased coating failures in high-speed coating of a silver halide photographic emulsion, and low adhesion between coating layers in a manufactured silver halide photographic light-sensitive material.

Further, inferior pressure characteristics (or pressure resistance) are known as another shortcoming of tabular silver halide grains. The term "pressure characteristics" is intended to include pressure fogging which indicates development of unexposed portions and pressure desensitization which indicates lowering in sensitivity, each of which is caused when pressure is applied to a silver halide photographic light-sensitive material. Serious defects may develop in a photographic light-sensitive material when these characteristics are inferior. Generally, silver halide grains are susceptible to pressure and become more susceptible as the sensitivity is raised, and such a tendency is particularly remarkable in tabular silver halide grains. This is attributed to the fact that since tabular grains are subjected, for their thinness, to a moment larger than spherical grains when these grains are the same in volume and, as a whole, the mechanical strength of tabular grains becomes weaker even when the material of tabular grains is the same as that of spherical grains.

Besides the form of silver halide grains, these pressure characteristics also depend upon the silver halide composition of these grains and the conditions of chemical sensitization. Generally, a poor chemical sensitization (a poor chemical ripening) causes a large pressure desensitization, and an excessive chemical sensitization, though it reduces the pressure desensitization, intensifies the pressure fogging. When high iodide content portions are present inside silver halide grains, the pressure fogging tends to decrease but the pressure desensitization is apt to increase.

As preventive measures against deterioration in these pressure characteristics, there have been disclosed various means in Japanese Pat. O.P.I. Pub. Nos. 99433/1984, 301937/1988, 149641/1988, 106746/1988, 151618/1988, 220238/1988, 131541/1989, 193138/1990, 172836/1991 and 231739/1991; but, any of these means is not effective in producing desirable results.

In addition, the above Japanese Pat. O.P.I. Pub. Nos. 163451/1988, 131541/1989, WO No. 91/18320 and EP No. 515894A1 contain neither description suggesting relations between the distance between parallet twin planes or its variation coefficient and aging stability or pressure characteristics, nor description suggesting improvements in such stability and characteristics.

SUMMARY OF THE INVENTION

Accordingly, the object of the present invention is firstly to provide a light-sensitive silver halide photographic emulsion comprising tabular silver halide grains high in sensitivity, low in residual coloring and excellent in pressure resistance, secondly to provide a silver halide photographic light-sensitive material high in sensitivity, low in residual coloring and excellent in pressure resistance, thirdly to provide a medical silver halide photographic light-sensitive material high in sensitivity, low in residual coloring and excellent in sharpness, aging stability and pressure resistance, and fourthly to provide a method for processing a medical radiographic silver halide photographic light-sensitive material, which gives processing high in sensitivity, low in residual coloring and excellent in sharpness and pressure resistance.

As the result of studies on adsorption of spectral sensitizing dyes and structure of tabular grains, particularly the distance between parallet twin planes thereof, the present inventors have found that the above object of the present invention is achieved by the following constituents.

A light-sensitive silver halide photographic emulsion is provided, wherein 70% or more of the total projected area of silver halide grains contained therein is accounted for by tabular silver halide grains whose average aspect ratio of (grain size)/(grain thickness) is 2 or more, the average of the longest distances (a) between 2 or more parallel twin planes contained in the respective tabular grains is 0.008 μm or more, the variation coefficient of (a) is 35% or less, and said silver halide photographic emulsion is spectrally sensitized by the addition of a dispersion of a substantially slightly water-soluble sensitizing dye dispersed, in the form of solid particles, in an aqueous solution substantially free from organic solvents and/or surfactants.

DETAILED DESCRIPTION OF THE INVENTION

The technique for mechanically dispersing an organic dye (coloring material) in an aqueous medium is made known by Japanese Pat. O.P.I. Pub. No. 288842/1992. However, the object of this technique is to make an organic dye nondiffusible in a photographic light-sensitive material, and the technique itself is a mere dispersion addition method. In contrast with this, the present invention is accomplished with the aim of having a photographic spectral sensitizing dye adsorbed effectively and uniformly on the surface of silver halide grains; therefore, it is different, in object and effect, from the above technique for the sake of only dispersing and adding.

As solvents for sensitizing dyes, there have been used water-miscible organic solvents such as alcohols, ketones, nitriles and alkoxy alcohols. Typical examples include methanol, ethanol, n-propyl alcohol, isopropyl alcohol, ethylene glycol, propylene glycol, 1,3-propane diol, acetone, acetonitrile, 2-methoxyethanol and 2-ethoxyethanol. In the embodiment of the invention, however, these organic solvents are not contained in substance at the addition of a sensitizing dye to a silver halide photographic emulsion.

As dispersing agents for sensitizing dyes, there so far have been used surfactants comprising anionic type, cationic type, nonionic type and amphoteric type. In the invention, however, these surfactants are not contained in substance.

In the invention, the term "an aqueous solution substantially free from organic solvents and/or surfactants" means water of which impurity content is low enough not to have adverse influences upon a silver halide photographic emulsion and, preferably, deionized water or distilled water.

The solubility of spectral sensitizing dyes used in the invention to water is $2\times10^{-4}$ to $4\times10^{-2}$ mol/liter and preferably $1\times10^{-3}$ to $4\times10^{-2}$ mol/liter.

When the solubility is lower than the above range, the size of dispersed solid particles becomes very large and uneven, and thereby dispersed particles may precipitate after the completion of dispersing, or troubles may arise in adsorption of a dye to silver halide grains at the addition of a dispersion to a silver halide photographic emulsion.

On the other hand, it has become apparent through the study of the present inventors that when the solubility is higher than the above range, a dispersion becomes excessively viscous and entraps air bubbles to hinder dispersing, and that a much higher solubility makes dispersing impossible.

In the invention, the solubility of a spectral sensitizing dye to water was measured according to the following method.

Thirty ml of deionized water was poured into a 50-ml Erlenmeyer flask, a dye was added thereto in an amount sufficient to remain undissolved under visual observation, and then the mixture was stirred with a magnetic stirrer for 10 minutes while kept at 27° C. in a thermostatic chamber. The resultant suspension was filtered with a Filter Paper No. 2 (Toyo Filter Co., Ltd.), the filtrate was filtered with a disposable filter (Toso Co., Ltd.), the filtrate was diluted properly and subjected to measurement of absorbance using a U-3410 spectrophotometer (Hitachi, Ltd.). Using the measurement results, the concentration of the solution was determined according to Beer-Lambert law given by the following equation:

$D=\epsilon lc$ (D: absorbance, $\epsilon$: spectral absorption coefficient, l: length of absorbance measuring cell, c: concentration), and then the solubility was determined.

Spectral sensitizing dyes used in the invention are those which undergo electron transfer toward silver halide and contribute to the sensitization of silver halide grains when optically excited in a state of being adsorbed on silver halide grains, and organic dyes used as filters against light are not included in the invention.

Spectral sensitizing dyes of the invention may have any chemical structure as long as their solubility to water is in a range of $2\times10^{-4}$ to $4\times10^{-2}$ mol/liter. Suitable examples include cyanine dyes, merocyanine dyes, complex cyanine dyes, complex merocyanine dyes, holopolar cyanine dyes, styryl dyes, hemicyanine dyes, oxonol dyes and hemioxonol dyes.

Spectral sensitizing dyes preferably employed in the invention are disclosed, for example, in U.S. Pat. Nos. 3,522,052, 3,619,197, 3,713,828, 3,615,643, 3,615,632, 3,617,293, 3,628,964, 3,703,377, 3,666,408, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, 2,503,776, Japanese Pat. O.P.I. Pub. Nos. 76525/1973, 88293/1993 and Belgian Pat. No. 691,807.

In the embodiment of the invention, using cyanine dyes as spectral sensitizing dyes produces particularly preferred results. Further, preferred sensitizing dyes are those cyanine dyes which have the structure represented by the following formula (I) or (II):

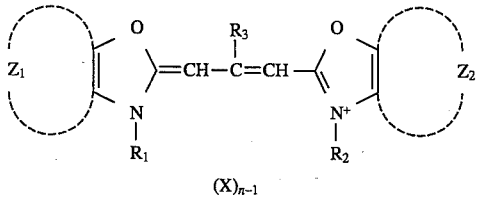

In the spectral sensitizing dye represented by formula I, $R_1$ and $R_2$ each represent a substituted or unsubstituted alkyl group, a substituted or unsubstituted alkenyl group or a substituted or unsubstituted aryl group, provided that one of $R_1$ and $R_2$ is a sulfoalkyl group or a carboxyalkyl group; $R_3$ represents a hydrogen atom, an alkyl group or an aryl group; $Z_1$ and $Z_2$ each represent a non-metallic atomic group necessary to form a benzene ring or a naphthalene ring, each of which may have a substituent; X represents an ion necessary to neutralize the intramolecular charge; and n represents 1 or 2, provided that n is 1 when an intramolecular salt is formed.

Examples of the substituted or unsubstituted alkyl group represented by $R_1$ or $R_2$ include lower alkyl groups such as a methyl, ethyl, propyl and butyl group.

The substituted alkyl group represented by $R_1$ or $R_2$ includes, for example, hydroxyalkyl groups such as a 2-hydroxyethyl and 4-hydroxybutyl group, acetoxyalkyl groups such as a 2-acetoxyethyl and 3-acetoxybutyl group, carboxyalkyl groups such as a 2-carboxyethyl, 3-carboxypropyl group and 2-(2-carboxyethoxy)ethyl group, and sulfoalkyl groups such as 2-sulfoethyl, 3-sulfopropyl, 3-sulfobutyl, 4-sulfobutyl, 2-hydroxy-3-sulfopropyl group. The alkenyl group represented by $R_1$ or $R_2$ includes, for example, an allyl, butynyl, octenyl and oleyl group. The aryl group represented by $R_1$ or $R_2$ includes, for example, a phenyl and carboxyphenyl group.

As stated above, however, at least one of $R_1$ and $R_2$ is a sulfoalkyl group or a carboxyalkyl group.

In formula I, the ion represented by X includes, for example, a chlorine ion, a bromine ion, an iodine ion, a thiocyanate ion, a sulfate ion, a perchlorate ion, a p-toluenesulfonate ion, an ethylsulfate ion, a sodium ion, a potassium ion, a magnesium ion and a triethyl ammonium ion.

$R_3$ represents a hydrogen atom, a lower alkyl group or an aryl group, in which the lower alkyl group includes a methyl, ethyl, propyl and butyl group, and the aryl group includes a phenyl group.

$Z_1$ and $Z_2$ each represent a non-metallic atomic group necessary to form a substituted or unsubstituted benzene ring. n represents 1 or 2, provided that n is 1 when an intramolecular salt is formed.

The sensitizing dyes represented by formula I can be easily synthesized according to the methods described in F. M. Hamer, Heterocyclic Compounds, Cyan Dyes and Related Compounds, Chap. IV.,V.,VI., pp.89–199, John Wiley & Sons (New York, London), 1964 or D. M. Sturmer, Heterocyclic Compounds Special Topics in Heterocyclic Chemistry, Chap. VIII,IV, pp.482–515, John Wiley & Sons (New York, London), 1977.

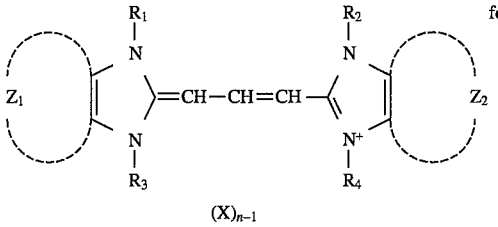

formula (II)

In the formula (II), $R_1$ and $R_2$ each represent a substituted or unsubstituted alkyl group, and $R_3$ and $R_4$ each represent an alkyl group, a hydroxyalkyl group, a sulfoalkyl group or a carboxyalkyl group. X is an ion necessary to neutralize the electric charge in the molecule, $Z_1$ and $Z_2$ each represent a nonmetallic atomic group necessary to form a benzene or naphthalene ring which may have a substituent, and n represents 1 or 2, provided that n is 1 when an intramotecular salt is formed.

With respect to $R_1$ and $R_2$ in formula II, the substituted alkyl group includes, for example, a hydroxymethyl, ethoxycarbonylethyl, ethoxycarbonylmethyl, allyl, benzyl, phenethyl, methoxyethyl, methanesulfonylaminoethyl and 3-oxobutyl group; and the unsubstituted alkyl group includes lower alkyl groups such as a methyl, ethyl, propyl and butyl group.

In the alkyl group represented by $R_3$ or $R_4$, the lower alkyl group having 1 to 5 carbon atoms includes, for example, a methyl, ethyl, butyl and trifluoroethyl group; the alkyl group substituted with a hydrophilic group includes, for example, a carboxymethyl, carboxyethyl, methanesulfonylaminoethyl, sulfobutyl, sulfoethyl, sulfopropyl, sulfopentyl, 6-sulfo-3-oxahexyl, 4-sulfo-3-oxapentyl, 10-sulfo-3,6-dioxadecyl, 6-sulfo-3-thiahexyl, o-sulfobenzyl and p-carboxybenzyl group. Hydroxyalkyl group, sulfoalkyl group and carboxyalkyl group represented by $R_3$ or $R_4$ includes those exemplified with respect to $R_1$ and $R_2$.

The ion represented by X, which is necessary to neutralize the charge in the molecule, may be either an anion or a cation. Examples of the anion include a halogen (e.g., chlorine, bromine or iodine) ion, a perchlorate ion, an ethylsulfate ion, a thiocyanate ion, a p-toluenesulfonate ion, a perfluoroborate ion; examples of the cation include a hydrogen ion, an alkali metal (e.g., lithium, sodium or potassium) ion, an alkali earth metal (e.g., magnesium or calcium) ion, an ammonium ion, an organic ammonium (e.g., triethyl ammonium, triethanol ammonium or tetramethyl ammonium) ion.

Among the sensitizing dyes represented by formula II, preferred are those represented by the following formula II':

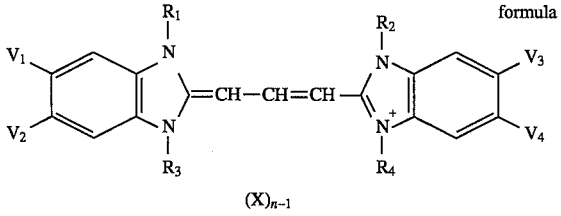

formula II'

In the formula, $R_1$ and $R_2$ each represent a substituted or unsubstituted alkyl group, provided that both $R_1$ and $R_2$ are not ethyl groups concurrently; $R_3$ and $R_4$ each represent a lower alkyl group, and at least one of $R_3$ and $R_4$ represents an alkyl group substituted with a hydrophilic group. $V_1$, $V_2$, $V_3$ and $V_4$ each represent a group selected from a halogen (e.g., fluorine, chlorine, bromine or iodine) atom, an alkyl (e.g., methyl, ethyl or t-butyl) group, an alkoxy (e.g., methoxy) group, an alkylthio (e.g., methylthio) group, a trifluoromethyl group, a cyano group, a carboxyl group, an alkoxycarbonyl (e.g., methoxycarbonyl or ethoxycarbonyl) group, an acyl (e.g., acetyl) group, a sulfonyl (e.g., methanesulfonyl) group, a carbamoyl (e.g., carbamoyl, N,N-dimethylcarbamoyl or N-morpholinocarbamoyl) group, a sulfamoyl (e.g., sulfamoyl or N,N-dimethyl) group, an acetylamino group and an acetyloxy group, provided that $V_1$, $V_2$, $V_3$ and $V_4$ are not hydrogen atoms or chlorine atoms concurrently. Each of $V_1$, $V_2$, $V_3$ and $V_4$ may further have a substituent in itself.

x represents an ion necessary to neutralize the charge in the molecule, and n represents 1 or 2, provided that n is 1 when an intramolecular salt is formed.

In $R_1$ and $R_2$ of formula II', the substituted alkyl group and unsubstituted alkyl group include those exemplified with respect to formula II.

The lower alkyl group represented by $R_3$ or $R_4$ includes those exemplified as $R_3$ or $R_4$ with respect to formula II.

Examples of the ion represented by X, which is necessary to neutralize the charge in the molecule, include those exemplified as X with respect to formula II. The substituents respectively represented by $V_1$, $V_2$, $V_3$ and $V_4$ are preferably those which give a sum not exceeding 1.7 when their Hammett's σp values are added together.

It is particularly preferred that the substituents respectively represented by $V_1$, $V_2$, $V_3$ and $V_4$ be those giving an S value, derived from the following equation A, of 1.0 or less.

$$S=L/\{(B_1+B_2+B_3+B_4)/2\} \quad \text{(Equation-A)}$$

where L, $B_1$, $B_2$, $B_3$ and $B_4$ each represent a sterimol parameter.

Preferred examples include a methyl (S=0.815), ethyl (S=0.992), t-butyl (S=0.728), methoxy (S=0.993), methylthio (S=0.982), trifluoromethyl (S=0.697), acetyl (S=0.893), methanesulfonyl (S=0.825), carboxyl (S=0.887) carbamoyl (S=0.93) and sulfamoyl (S=0.726) group, as well as a fluorine (S=0.981), chlorine (S=0.978) and bromine (S=0.982) atom.

The Hammett's value used here is a substituent constant determined by Hammett and others from the electronic effect of substituents exerted on the hydrolysis of benzoates, and the sterimol parameter is a value defined by a length determined from a projection drawing of a substituent's bonding axis with the benzene nucleus and described in detail in Journal of Organic Chemistry, Vol.23, pp.420–427 (1958), JIKKEN KAGAKU KOZA (Library of Experimental Chemistry), Vol.14, Maruzen Co.,Ltd., Physical Organic Chemistry, McGraw Hill Book Co., 1940, Drug Design, Vol.VII, Academic Press New York, 1976 and YAKUBUTSU NO KOZO KASSEI SOKAN (Correlation between Structure and Activity of Drugs), Nankodo Co., Ltd., 1979.

The spectral sensitizing dyes of formula II according to the invention can be synthesized by the methods described, for example, in British Pat. Nos. 521,165, 745,546, Belgian Pat. No. 615,549, Soviet Pat. Nos. 412,218, 432,166, Japanese Pat. Exam. Pub. Nos. 7828/1963, 27165/1967, 27166/1967, 13823/1968, 14497/1968, 2530/1969, 27676/1970 and 32740/1970, Cyanine Dyes and Related Compounds, Jhon Wiley & Sons, New York, 1964.

Incidentally, each of the above formulas I and II indicates only one state of resonance structure; therefore, even when the dye's structure is given in an extreme state in which the positive charge is hold by the nitrogen atom in the counter heterocycle, it represents the identical substance.

The above spectral sensitizing dyes are added, singly or in combination, to obtain a desired spectral sensitivity. Preferred is a combination of a dye of formula I and that of II, particularly a dye of formula I and that of formula II'.

The combination of two types of spectral sensitizing dyes is useful for a light-sensitive material which requires sensitivity to green light. This combination is very useful for a radiographic material which uses a green-fluorescing phosphor to raise the sensitivity to X-rays. In practice, it is particularly suitable for a medical radiographic light-sensitive material.

In applying them to a medical radiographic light-sensitive material containing a green-fluorescing phosphor, it is preferred that when a reflection spectrum is measured using silver halide emulsion grains on which a spectral sensitizing dye of formula I and a spectral sensitizing dye of formula II, particularly formula II', are adsorbed in combination, a J-band be formed in the same wavelength region as green light from the phosphor. In other words, it is preferred that the spectral sensitizing dyes be appropriately selected and combined so as to form a specific J-band in the region of 520 nm to 560 nm.

As a matter of course, these spectral sensitizing dyes in such a preferred combination may be jointly used with other spectral sensitizing dyes. Jointly usable dyes include cyanine dyes, merocyanine dyes, complex cyanine dyes, complex merocyanine dyes, holopolar cyanine dyes, hemicyanine dyes, styryl dyes and hemioxonol dyes. Particularly useful are cyanine dyes, merocyanine dyes and complex merocyanine dyes. These dyes may have any of the nuclei usually utilized, such as a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus or a pyridine nucleus. Also usable are the nuclei obtained by binding of these nuclei with an aliphatic hydrocarbon ring such as an indolenine nucleus, an benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have a substituent on a carbon atom.

Merocyanine dyes and complex merocyanine dyes may have, as a nucleus with ketomethine structure, a 5- or 6-membered heterocycle such as a pyrazoline-5-one nucleus, a thiahydantoin nucleus, a 2-thioxazolidine-2,4-dione nucleus, a rhodanine nucleus or a thiobarbituric acid nucleus.

These dyes are those described, for example, in German Pat. No. 929,080, U.S. Pat. Nos. 2,231,658, 2,493,748, 2,503,776, 2,519,001, 2,912,329, 3,655,394, 3,656,959, 3,672,897, 3,649,217, British Pat. No. 1,242,588 and Japanese Pat. Exam. Pub. No. 14030/1969.

Further, there may be added to the emulsion layer, together with these spectral sensitizing dyes, a substance which has a supersensitizing function and is a dye having no spectral sensitizing property or a substance substantially incapable of absorbing visible light.

The amount of the spectral sensitizing dyes to be added varies with the type of dyes and the structure, composition, ripening conditions, purpose and applications of silver halide; but, it is preferred to be 40 to 90% of the saturation coverage (monomolecular layer coverage) at the surface of each light-sensitive grain in a silver halide emulsion, especially 50 to 80%. In the invention, the saturation coverage is given as a value relative to the saturated adsorption of a dye, obtained by drawing an adsorption isothermal line at 50° C., which is set to be 100% coverage. The saturation coverage is referred to T. H. James, The Theary of the Photographic Process, PP236–239 Forth edition, Mac Millan Publishing Co., Inc. (1977).

The suitable amount of the dye per mol of silver halide depends upon the total surface area of silver halide grains in an emulsion, but usually not more than 2000 mg, preferably not more than 600 mg and especially not more than 450 mg. An important feature of the invention is that the spectral sensitizing dye is added in the form of dispersion of fine solid particles; therefore, the amount of the sensitizing dye added becomes smaller as compared with the addition in the form of solution of organic solvents.

The addition of the spectral sensitizing dye of the invention may be made during the chemical ripening process, preferably at the beginning of chemical ripening. A spectrally sensitized silver halide emulsion of high sensitivity can also be effectively obtained by the addition during the processes from nucleus formation to end of desalting of the silver halide emulsion of the invention. Further, the same dye as that added in the above process (from nucleus formation to end of desalting) or another spectral sensitizing dye of the invention may be additionally added anytime in the period from end of desalting and chemical ripening to just before coating.

The following are typical examples, but the scope of the invention is not limited to them.

Exemplified Compounds (D-16)

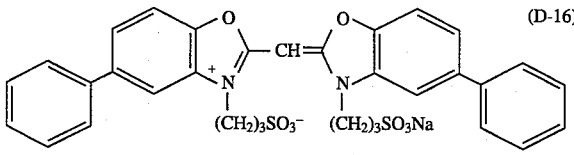

(D-17)

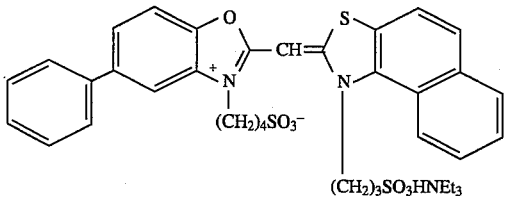

(D-18)

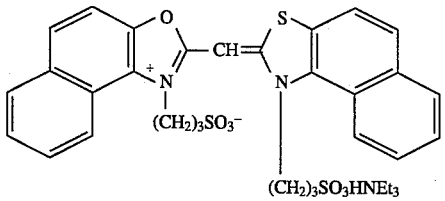

(D-19)

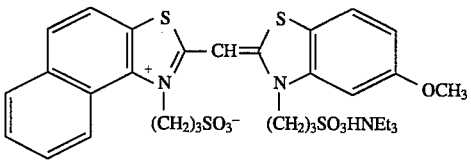

(D-20)

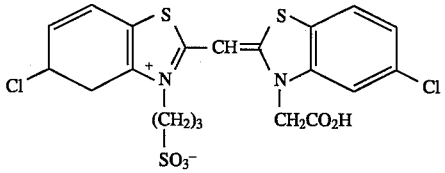

(D-21)

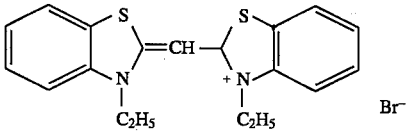

-continued
Exemplified Compounds
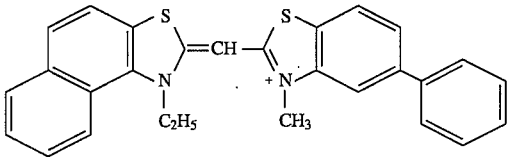
(D-22)
$Br^-$
-continued
Exemplified Compounds
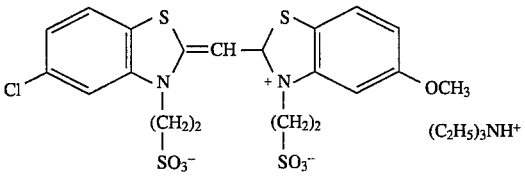
(D-23)
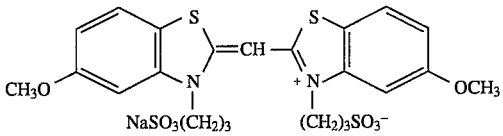
(D-24)
Typical examples of the spectral sensitizing dye of formula I are as follows:
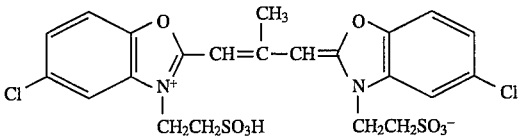
I-1
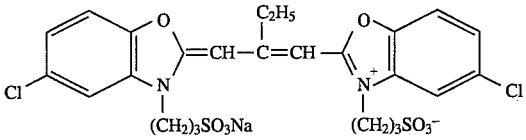
I-2
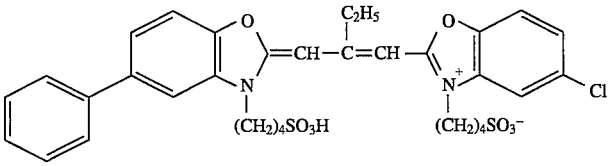
I-3
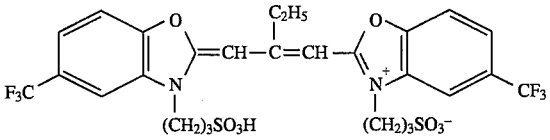
I-4
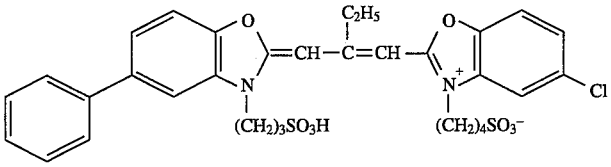
I-5
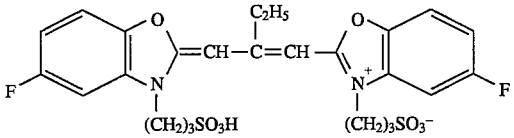
I-6
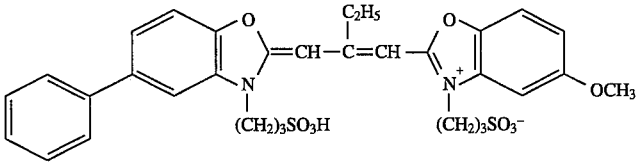
I-7
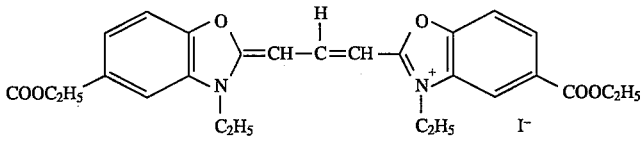
I-8

-continued
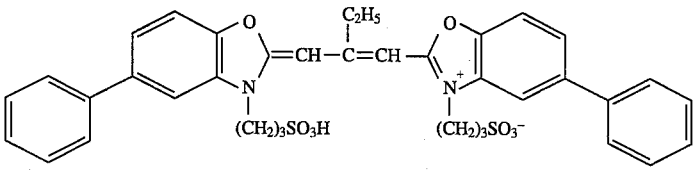
I-9
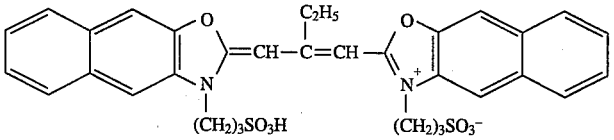
I-10
Typical examples of the spectral sensitizing dye of formula II' are as follows:

TABLE 1

| Dye | $R_1$ | $R_2$ | $R_3$ | $R_4$ | $X_1$ | $V_1$ | $V_2$ | $V_3$ | $V_4$ |
|---|---|---|---|---|---|---|---|---|---|
| II'-1 | $CH_3$ | $(CH_2)_3SO_3H$ | $CH_3$ | $(CH_2)_3SO_3^-$ | $Na^+$ | Cl | H | Cl | H |
| II'-2 | $CH_3$ | $(CH_2)_3SO_3H$ | $CH_3$ | $(CH_2)_3SO_3^-$ | $Na^+$ | H | $SCH_3$ | H | $SCH_3$ |
| II'-3 | $CH_3$ | $(CH_2)_2SO_3H$ | $CH_3$ | $(CH_2)_2SO_3^-$ | $K^+$ | H | F | H | F |
| II'-4 | $CH_3$ | $(CH_2)_4SO_3H$ | $CH_3$ | $(CH_2)_4SO_3^-$ | $Na^+$ | H | CN | H | CN |
| II'-5 | $CH_3$ | $(CH_2)_3SO_3^-$ | $CH_3$ | $C_2H_4NHSO_2CH_3$ | — | H | $CONH_2$ | H | $CONH_2$ |
| II'-6 | $CH_3$ | $CH_3$ | $CH_3$ | $(CH_2)_3SO_3^-$ | — | $CH_3$ | $CH_3$ | H | $CF_3$ |
| II'-7 | $C_2H_4OH$ | $(CH_2)_3SO_3^-$ | $C_2H_4OH$ | $(CH_2)_3SO_3^-$ | $K^+$ | H | $SO_2NH_2$ | H | $SO_2NH_2$ |
| II'-8 | $C_2H_5$ | $(CH_2)_3SO_3^-$ | $CH_3$ | $C_2H_5$ | — | H | $CF_3$ | $CH_3$ | $CH_3$ |
| II'-9 | $CH_3$ | $(C_2H_4O)_2C_3H_5SO_3^-$ | $CH_3$ | $(C_2H_4O)_2C_3H_5SO_3^-$ | $Na^+$ | H | $COCH_3$ | H | $COCH_3$ |
| II'-10 | $C_2H_5$ | $(CH_2)_3SO_3^-$ | $CH_3$ | $CH_3$ | — | H | $CF_3$ | H | $CH_3$ |
| II'-11 | $C_2H_4COCH_3$ | $CH_2COOH$ | $C_2H_4OCH_3$ | $(CH_2)_2SO_3^-$ | — | H | $CF_3$ | H | $CF_3$ |
| II'-12 | $CH_3$ | $(CH_2)_3SO_3^-$ | $CH_3$ | $(CH_2)_3SO_3^-$ | $Na^+$ | H | $SO_2F$ | H | $SO_2F$ |
| II'-13 | $CH_3$ | $C_2H_5$ | $CH_3$ | $(CH_2)_3SO_3^-$ | — | H | $SCH_3$ | H | $CF_3$ |
| II'-14 | $C_2H_5$ | $C_2H_4NHSO_2CH_3$ | $CH_3$ | $(CH_2)_4SO_3^-$ | — | H | F | H | F |
| II'-15 | $CH_3$ | $(CH_2)_3SO_3^-$ | $C_2H_5$ | $CH_2CF_3$ | — | H | $CF_3$ | H | $CF_3$ |
| II'-16 | $CH_3$ | $(CH_2)_3SO_3^-$ | $CH_3$ | $(CH_2)_3SO_3^-$ | $Na^+$ | H | $CF_3$ | H | $CF_3$ |
| II'-17 | $CH_3$ | m-sulfonium-tolyle | $C_2H_5$ | $(CH_2)_4SO_3^-$ | $Na^+$ | H | $COOCH_3$ | H | $COOCH_3$ |
| II'-18 | $C_2H_5$ | $C_2H_5$ | $CH_3$ | $(CH_2)_2SO_3^-$ | — | H | $CF_3$ | H | $CF_3$ |
| II'-19 | $CH_3$ | $C_2H_4OC_3H_5SO_3^-$ | $CH_3$ | $C_2H_4OC_3H_5SO_3^-$ | $K^+$ | H | $SO_2CH_3$ | H | $SO_2CH_3$ |
| II'-20 | $CH_3$ | $CH_2CF_3$ | $CH_3$ | $(CH_2)_3SO_3^-$ | — | H | $CF_3$ | H | $CF_3$ |
| II'-21 | $CH_3$ | $(CH_2)_3SO_3^-$ | $C_2H_5$ | $(CH_2)_3SO_3^-$ | $Na^+$ | H | $SO_2CH_3$ | H | $SO_2CH_3$ |
| II'-22 | $CH_3$ | $(CH_2)SO_3H$ | $CH_3$ | $(CH_2)_3SO_3^-$ | $K^+$ | H | $CF_3$ | H | $CF_3$ |
| II'-23 | $C_2H_5$ | $CH_2CF_3$ | $CH_3$ | $(CH_2)_3SO_3^-$ | — | H | $CF_3$ | H | $CF_3$ |
| II'-24 | $CH_3$ | $CH_2COOH$ | $CH_3$ | $(CH_2)_4SO_3^-$ | — | H | $COCH_3$ | H | $SCH_3$ |
| II'-25 | $CH_3$ | $CH_2COOCH_3$ | $CH_3$ | $(CH_2)_3SO_3^-$ | — | H | $CF_3$ | H | $CF_3$ |
| II'-26 | $C_2H_5$ | $CH_2COOCH_3$ | $CH_3$ | $(CH_2)_3SO_3^-$ | — | H | $CF_3$ | H | $CF_3$ |
| II'-27 | $CH_2COOC_2H_5$ | $(CH_2)_3SO_3^-$ | $CH_3$ | $CH_2COOH$ | — | $CONH_2$ | H | H | $COCH_3$ |
| II'-28 | $CH_3$ | $CH_2COOCH_3$ | $C_2H_5$ | $(CH_2)_3SO_3^-$ | — | H | $CF_3$ | H | $CF_3$ |
| II'-29 | $CH_3$ | $CH_2COOH$ | $CH_3$ | $CH_2COO^-$ | $Na^+$ | H | $SCH_3$ | H | $SCH_3$ |
| II'-30 | $C_2H_5$ | $CH_2CONH_2$ | $CH_3$ | $(CH_2)_3SO_3^-$ | — | H | $CF_3$ | H | $CF_3$ |
| II'-31 | $C_2H_5$ | $CH_2COOC_2H_5$ | $CH_3$ | $(CH_2)_3SO_3^-$ | — | H | $CF_3$ | H | $CF_3$ |
| II'-32 | $C_2H_4OH$ | $(CH_2)_2SO_3^-$ | $C_2H_4OH$ | $(CH_2)SO_3^-$ | $K^+$ | H | H | H | H |
| II'-33 | $C_2H_5$ | $CH_2COOC_3H_7$ | $CH_3$ | $(CH_2)_3SO_3^-$ | — | H | $CF_3$ | H | $CF_3$ |
| II'-34 | $CH_3$ | $(CH_2)_5SO_3^-$ | $CH_3$ | $(CH_2)_3SO_3^-$ | $Li^+$ | $CF_3$ | Cl | $CH_3$ | Cl |
| II'-35 | $C_2H_5$ | $CH_2CON(CH_3)_2$ | $CH_3$ | $(CH_2)_3SO_3^-$ | — | H | $CF_3$ | H | $CF_3$ |
| II'-36 | $CH_3$ | m-sulfonium-tolyle | $CH_3$ | $C_2H_4NHSO_2CH_3$ | — | H | $COCH_3$ | H | $COCH_3$ |
| II'-37 | $CH_3$ | $CH_2NHC_2H_4SO_3^-$ | $CH_3$ | $CH_2CF_3$ | — | $SCH_3$ | $CF_3$ | $SCH_3$ | $CH_3$ |
| II'-38 | $CH_3$ | $(CH_2)_4SO_3^-$ | $C_2H_5$ | $(CH_2)_4SO_3^-$ | $Na^+$ | H | CN | H | CN |
| II'-39 | $CH_3$ | $CH_2CN$ | $CH_2H_5$ | $(CH_2)_3SO_3^-$ | — | H | $CF_3$ | H | $CH_3$ |
| II'-40 | $C_2H_5$ | $(CH_2)_3SO_3^-$ | $CH_3$ | $CH_2COOH$ | — | H | $SO_2CH_3$ | H | $SCH_3$ |
| II'-41 | $CH_3$ | $CH_2COCNHC_2H_{23}SO_3^-$ | $CH_3$ | $C_2H_4$ | — | H | $CF_3$ | H | $CF_3$ |
| II'-42 | $CH_3$ | $CH_2CF_3$ | $CH_3$ | $(CH_2)_4SO_3^-$ | — | H | $CF_3$ | H | $CF_3$ |
| II'-43 | $CH_3$ | $CH_2COOCH_3$ | $CH_3$ | $(CH_2)_3SO_3^-$ | — | H | COOH | H | COOH |
| II'-44 | $C_2H_2CF_3$ | $CH_3$ | $CH_3$ | $C_2H_4CH(CH_3)_3SO_3^-$ | — | $CF_3$ | H | H | $CF_3$ |
| II'-45 | $C_2H_4OCH_3$ | $(CH_2)_3SO_3^-$ | $C_2H_4OCH_3$ | $(CH_2)_3SO_3^-$ | $K^+$ | H | $SO_2NH_2$ | H | $SO_2NH_2$ |
| II'-46 | $CH_3$ | $CH_2CF_3$ | $CH_3$ | $(CH_2)_2SO_3^-$ | — | H | $CF_3$ | H | $CF_3$ |
| II'-47 | $CH_3$ | $CH_2CF_3$ | $CH_3$ | $CH_2CONHCH_2SO_3^-$ | — | H | $CF_3$ | H | $CF_3$ |
| II'-48 | $CH_3$ | $(C_2H_4O)_2C_3H_5SO_3^-$ | $CH_3$ | $(C_2H_4O)_2C_3H_5SO_3^-$ | $Na^+$ | H | $COCH_3$ | H | $COCH_3$ |
| II'-49 | $CH_2CH{=}CH_2$ | $(CH_2)_2SO_3^-$ | $CH_2CH{=}CH_2$ | $(CH_2)_2SO_3^-$ | $Na^+$ | H | $CONH_2$ | H | $CONH_2$ |

TABLE 1-continued

| Dye | $R_1$ | $R_2$ | $R_3$ | $R_4$ | $X_1$ | $V_1$ | $V_2$ | $V_3$ | $V_4$ |
|---|---|---|---|---|---|---|---|---|---|
| II'-50 | $CH_2CH_2OH$ | $(CH_2)_4SO_3^-$ | $CH_2CH_2OH$ | $(CH_2)_4SO_3^-$ | — | H | $COOCH_3$ | H | $COOCH_3$ |
| II'-51 | $CH_3$ | $(CH_2)_2SO_3^-$ | $CH_2H_4OH$ | $(CH_2)_2SO_3^-$ | $Na^+$ | H | F | H | F |
| II'-52 | $CH_2CH_2OH$ | $CH_2COOH$ | $C_2H_5$ | $(CH_2)_3SO_3^-$ | — | H | $SO_2CF_3$ | H | $OCH_3$ |
| II'-53 | $(C_2H_4O)_2H$ | $(CH_2)_3SO_3^-$ | $CH_3$ | $C_2H_4COCH_3$ | — | H | $SO_2N$ | $CH_3$ | $CH_3$ |
| II'-54 | $CH_3$ | $C_2H_4S(CH_2)_4SO_3^-$ | $CH_3$ | $C_2H_4S(CH_2)_4SO_3^-$ | $Na^+$ | H | $SO_2CH_3$ | H | $SO_2CH_3$ |
| II'-55 | $CH_3$ | $C_3H_6SO_3^-$ | $CH_3$ | $C_3H_6SO_3^-$ | $Na^+$ | H | $CF_3$ | H | H |
| II'-56 | $CH_3$ | $C_3H_6SO_3^-$ | $CH_3$ | $C_2H_5$ | — | H | $CF_3$ | H | H |
| II'-57 | $CH_3$ | $C_3H_6SO_3^-$ | $CH_3$ | $C_3H_6SO_3^-$ | $Na^+$ | H | $CF_3$ | H | Cl |
| II'-58 | $CH_3$ | $C_3H_6SO_3^-$ | $CH_3$ | $C_3H_6SO_3^-$ | $Na^+$ | H | $CF_3$ | H | F |
| II'-59 | $CH_3$ | $C_3H_6SO_3^-$ | $CH_3$ | $C_2H_5$ | — | H | $CF_3$ | H | F |
| II'-60 | $CH_3$ | $C_3H_6SO_3^-$ | $C_2H_5$ | $C_3H_6SO_3^-$ | $Na^+$ | H | $CF_3$ | H | H |

Besides the above examples, the dyes represented by formula II' of the invention also include, for example, those exemplified in Japanese Pat. O.P.I. Pub. No. 9040/1992 with the reference numbers of II-3, II-4, II-6, II-7, II-8, II-10, II-13, II-14, II-16, II-17, II-18, II-20 II-21 and II-24 to II-44.

In embodying the invention, various dispersers can be employed to grind and disperse a spectral sensitizing dye mechanically in an aqueous system. In practice, a high-speed stirrer, a ball mill, a sand mill, a colloid mill, an attritor and a supersonic disperser are used. Using a high-speed stirrer is preferred.

This high-speed stirring disperser may be one having a dissolver mounting a plurality of impellers on its vertical shaft or one having a multidissolver provided with a plurality of vertical shafts. A much preferred high-speed stirring disperser is one having an anchor blade. In a typical example of operation, a prescribed amount of spectral sensitizing dye is put into a temperature-controllable tank containing water and stirred with a high-speed stirrer for a prescribed period of time at a controlled temperature, followed by grinding and dispersing. The pH and temperature at which a spectral sensitizing dye is mechanically dispersed are not particularly limited; but, too low a temperature cannot give a desired particle size even after a prolonged dispersing, and too high a temperature also causes troubles such as reaggregation or decomposition which hinders the acquisition of desired photographic properties and reduction in viscosity of liquid medium which markedly lowers the efficiency of grinding and dispersing. Accordingly, the dispersing temperature is preferably 15° to 50° C. Further, a lower stirring rate in dispersing requires a longer time to obtain a desired particle size, and a higher stirring rate causes a trouble of entrapping air bubbles and thereby lowers the dispersing efficiency; therefore, dispersing at a stirring rate of 1000 to 6000 rpm is preferred.

The fine solid particles of spectral sensitizing dye dispersed by the method of the invention are preferably not more than 1 μm. The expression "not more than 1 μm" means that the volume average grain size is not more than 1 μm in terms of sphere equivalent particles. Measurement can be made according to the usual method.

The term "dispersion" used here means a suspension of a spectral sensitizing dye, and preferably such a suspension contains a spectral sensitizing dye in an amount of 0.2 to 5.0 wt %.

The dispersion prepared in the invention may be added to a silver halide photographic emulsion as it is, or after being properly diluted with water.

In the light-sensitive silver halide photographic emulsion of the invention, there may be used any of the silver halides employed in the usual silver halide photographic emulsion, such as silver bromide, silver iodobromide, silver iodochloride, silver chlorobromide, silver chloroiodobromide and silver chloride. Particularly preferred are silver bromide, silver iodobromide and silver chloroiodobromide. When silver iodobromide is used, the amount of silver iodide contained is preferably less than 2 mol % in terms of an average silver iodide content of the total silver halide grains.

The silver halide grains contained in the light-sensitive silver halide emulsion of the invention are tabular silver halide grains. Tabular silver halide grains are those having two parallel major faces facing each other and having, in average, a ratio of grain size to grain thickness (hereinafter referred to as aspect ratio) of 2.0 or more. The term "grain size" used here is a size of average projected area (hereinafter referred to as grain size), which is given by the diameter of a circle corresponding to the projected area of a tabular silver halide grain (diameter of a circle having the same area as the projected area of said silver halide grain), and "grain thickness" indicates the distance between two parallel major faces of a tabular silver halide grain.

The average aspect ratio of tabular silver halide grains contained in the light-sensitive silver halide photographic emulsion of the invention (hereinafter shortened at times to tabular silver halide grains of the invention) is preferably 2.0 or more and more preferably in a range of 3.0 to 20.

Crystallographically, tabular silver halide grains belong to twin crystals. Twin crystal are silver halide crystals having at least one twin plane in each crystal, and the classification of their forms is described in detail in the reports of Klein and Moisar, Photographishe Korrespondenz, Vol.99, p.99 and Vol.100, p.57.

The tabular silver halide grains of the invention have 2 or more twin planes parallel to the major face. These twin planes can be observed using a transmission electron microscope. In practice, the observation can be made as follows: firstly, a test sample is prepared by coating a light-sensitive silver halide photographic emulsion on a support so as to have the tabular silver halide grains oriented with their principal planes parallel to the support. The sample is sliced into microscopic sections having a thickness of about 0.1 μm by use of a diamond cutter. Twin planes can be confirmed by observing these sections on a transmission electron microscope.

The longest distance between twin planes (a) of the invention means a distance between twin planes when a grain has two twin planes, and the longest distance among distances between twin planes when a grain has 3 or more twin planes.

In the invention, the longest distance between twin planes (a) can be determined by selecting at random, through the observation of the above section using a transmission electron microscope, 100 tabular silver halide grains having a cross section nearly vertical to the major face, measuring (a) for each grain, and averaging the measured values.

In the invention, the average of values of (a) is not less than 0.008 μm, preferably not less than 0.010 μm and more preferably in a range of 0.012 to 0.05 μm.

When the value of (a) is smaller than 0.008 μm, the moisture resistance is lowered.

Besides the value of (a) being in the above range, it is also required in the invention that the variation coefficient of value of (a) be not more than 35% and preferably not more than 30%. Better photographic properties can be obtained as the value of (a) becomes smaller; when the value exceeds 35%, the sensitivity is lowered and both the moisture resistance and pressure resistance are deteriorated.

The grain size of tabular silver halide grains of the invention is preferably 0.4 to 3.0 μm and more preferably 0.4 to 2.0 μm.

The average thickness of tabular silver halide grains of the invention is preferably 0.05 to 1.0 μm, more preferably 0.05 to 0.40 μm and still more preferably 0.05 to 0.20 μm.

The grain size and thickness can be optimized so as to obtain the most desirable sensitivity, aging stability and pressure characteristics. In this optimization, the optimum grain size and optimum thickness vary according to other factors (thickness of a hydrophilic colloid layer, hardness, chemical ripening conditions, set sensitivity of a light-sensitive material, amount of silver coated, etc.), which affect the sensitivity, aging stability and pressure characteristics.

The tabular silver halide grains of the invention are preferably monodispersed ones having a narrow grain size distribution. To be more exact, when the width of the distribution is defined by the equation of (standard deviation of grain size/average grain size)×100=width of grain size distribution (%), the width of distribution is preferably not more than 25%, more preferably not more than 20% and still more preferably not more than 15%.

Preferably, the tabular silver halide grains of the invention have a distribution width of thickness as small as possible. To be more exact, when the width of the distribution is defined by the equation of (standard deviation of thickness/average thickness)×100=width of thickness distribution (%), the width of distribution is preferably not more than 25%, more preferably not more than 20% and still more preferably not more than 15%.

In the embodiment of the invention, the tabular silver halide grains are preferably hexagonal. Hexagonal tabular grains are those of which major faces [(111) faces] are hexagonal and have a side length ratio of 1.0 to 2.0. The expression "side length ratio" means the ratio of the length of the longest side of a haxagon to the length of the shortest side. In the invention, it is also preferred that the corners of the hexagonal tabular grains be rounded, on condition that their side length ratio is 1.0 to 2.0. When the corners are rounded, the length of a side is given by the distance between the intersecting points obtained by extending the straight portion of said side and extending the adjacent sides likewise. Further, it is also preferred that the corners be rounded much more to give tabular grains having a form near a circle.

Preferably, each side of a hexagon of hexagonal tabular grain of the invention has a substantially straight portion longer than one-half the length of its own. It is also preferred in the invention that the side length ratio be 1.0 to 1.5.

In embodying the invention, preferred tabular silver halide grains are core/shell type grains which have the inner portion and the outer portion which comprises at least one layer. Such core/shell type grains include double structure grains whose silver halide composition is different from inner portion of grains to outer portion and multi-layered structure grains disclosed in Japanese Pat. O.P.I. Pub. No. 245151/1986.

In these core/shell type grains, the silver iodide content of the core is preferably in a range from 2.5 mol % to the solid solution limit and more preferably in a range from 5 mol % to the solid solution limit. Further, the silver iodide content of the outermost shell usually forming the surface layer is preferably not more than 5 mol % and more preferably in a range of 0 to 2 mol %. The volume percentage of the core is preferably 2 to 60% and more preferably 5 to 50% of the whole grain volume.

The silver iodide distribution in the core may be either uniform or localized. For example, it may become higher in concentration from the central portion to the outer portion, or may have a maximum or minimum concentration in the middle portion.

Dislocations may exist in the tabular silver halide grains of the invention.

Dislocations of silver halide grains can be observed directly by a method which employs a transmission electron microscope at a low temperature as described, for example, in J. F. Hamilton, Phot. Sci. Eng., 11, 56 (1967) and T. Shiozawa, J. Soc. Phot. Japan, 35, 213(1972). To be concrete, silver halide grains taken out of an emulsion, with attention not to apply pressure as high as the grains undergo dislocation, are placed on a mesh for electron microscopy, and then observation is made according to the transmission method with the sample kept cold to prevent damages such as printout caused by electron beams. At the observation, using a high-voltage type (200 kv or more for a 0.25-μm thick grain) electron microscope gives a better observation, because the transmission of electron beams becomes more difficult as the thickness of grains becomes larger.

Using a photograph of grains obtained as above. the positions and number of dislocations can be determined for each grain.

In the invention, it is preferred that the positions of dislocations be within the region of 0.58 L to L from the center to the outer face of grains and, more preferably, the positions are within the region of 0.80 L to 0.98 L. The dislocation line, which runs in a direction roughly from the center to the outer face, may take a zigzag shape.

The center of a silver halide grain mentioned above is the center of a circle obtained, in a manner similar to that reported by Inoue and others in pages 46–48, Summaries of Speeches presented at the annual meeting of the Photographic Society of Japan, by the steps of dispersing and solidifying silver halide fine crystals in an acrylic resin, cutting out very thin sections with a microtome, selecting a section containing a crystal having the largest cross section and crystals whose cross sections are larger than 90% of that of the above crystal, and drawing a circumscribed circle which is the smallest in relation to the cross section.

The distance between the center and the outer face, L, is defined as the distance between the center of the above circle and a point at which the periphery of the grain and a line drawn outward from the center of the circle are intersecting.

In the invention, it is preferred that the percentage in number of silver halide grains having 5 or more dislocations account for 50% or more. More preferably, the percentage in number of grains having 5 or more dislocations accounts for 70% or more and, still more preferably, the percentage in number of grains having 10 or more dislocations accounts for 50% or more.

The light-sensitive silver halide photographic emulsion of the invention can be prepared by putting an aqueous solution of protective colloid and a seed emulsion into a reaction vessel, and subjecting the seed grains to the Ostwald ripening and grain growth with the addition of silver ions, halogen ions, and/or a fine particle emulsion, and a silver halide solvent, if required.

In the manufacture of the light-sensitive silver halide photographic emulsion of the invention, 50% or more of the total projected area of seed grains contained in the seed emulsion are grains having two or more parallel twin planes, and both the variation coefficient of the thickness of said seed grains and the variation coefficient of the maximum intertwin-plane distance ($a_t$) of said seed grains are 35% or less.

When only the variation coefficient of the seed grain thickness or only that of ($a_t$) is not more than 35%, the variation coefficient of the intertwin-plane distance (a) of grains after growth cannot be controlled to a level not more than 35%; therefore, both the variation coefficients must be concurrently 35% or less. As the reason for this, it is conceived that though twin planes are generally thought to be formed in the course of nucleus formation, some of twin planes are formed during grain growth.

In manufacturing the light-sensitive silver halide photographic emulsion of the invention, the seed emulsion can be prepared by well-known methods such as the single-jet method, the controlled double-jet method and the like. The halide composition of the seed emulsion can be arbitrarily selected, and there can be used any of the silver halides including silver bromide, silver iodide, silver chloride, silver iodobromide, silver chlorobromide, silver chloroiodide and silver chloroiodobromide, but silver bromide and silver iodobromide are preferred.

The seed grains are not particularly limited in form as long as they have twin planes, and may be any of the tabular, octahedral, cubic and spheric grains.

Many of the twin planes contained in the seed grains are thought to be formed in the stage of nucleus formation. Accordingly, the intertwin-plane distance can be controlled in the stage of manufacturing the seed emulsion, by properly selecting combination of various factors such as gelatin concentration, temperature, iodine ion concentration, pBr, feed rate of ions, stirring rate, kind of gelatin, silver halide solvent, etc., which affect the supersaturated state during nucleus formation. Generally, when nucleus formation is carried out in a shorter time and in a higher supersaturation state, the distance between twin planes becomes narrower; on the contrary, forming nucleus in a longer time and in a lower supersaturation state makes the intertwinplane distance wider.

In the manufacture of the light-sensitive silver halide photographic emulsion of the invention, various known methods can be employed except that the above seed grains are used. The single-jet method, the double-jet method and the triple-jet method, for example, can be used in combination. Further, there can be jointly employed a method which controls the pH and pAg of a liquid phase where silver halide is formed, in response to the growth speed of silver halide. Furthermore, in order to change the silver halide composition of grains, the conversion method may be employed in any of the processes of forming silver halide. In addition, halide ions and silver ions may be supplied in the form of silver halide fine particles.

The manufacture of the emulsion can also be controlled by adjusting the conditions in the Ostwald ripening and grain growth, namely, gelatin concentration, temperature, iodine ion concentration, pBr, feed rate of ions, stirring rate, kind of gelatin, silver halide solvent, etc.

Japanese Pat. O.P.I. Pub. Nos. 92942/1988 and 213637/1989 contain detailed description of the factors relating to the supersaturation, which can be referred to when necessary.

Moreover, in manufacturing the tabular silver halide grains, silver halide solvents such as ammonia, thioether and thiourea can be used if necessary.

During the formation and/or growth of silver halide grains contained in the light-sensitive silver halide photographic emulsion of the invention, metallic elements can be introduced into the inner portion and/or outer portion of these grains by adding metallic ions using at least one salts selected from cadmium salts, zinc salts, lead salts, thallium salts, iridium salts (including complex salts), rhodium salts (including complex salts) and iron salts (including complex salts).

In the embodiment of the invention, gelatins are favorably used as dispersing media for protective colloid of silver halide grains. Preferred are alkali-processed gelatins, acid-processed gelatins, low-molecular gelatins (molecular weight: 20,000 to 100,000) and modified gelatins such as phthalated gelatins. In addition, other hydrophilic colloids can also be used; examples thereof include those described in Research Disclosure (hereinafter shortened to as RD), Vol.176, No.17643 (December, 1978), Sec.

The light-sensitive silver halide photographic emulsion of the invention may be subjected to desalting, during the growth of silver halide grains, to eliminate unnecessary soluble salts or may be used with such salts unremoved. When such salts are removed, desalting can be carried out according to the method described in RD, Vol.176, No.17643, Sec. II.

The light-sensitive silver halide photographic emulsion of the invention may be chemically sensitized. Conditions of chemical sensitization, or chemical ripening, such as pH, pAg, temperature and time are not particularly limited, and the conditions usually employed in the industry can be used. In carrying out chemical sensitization, there can be used singly or in combination sulfur sensitization which employs a sulfur-containing compound capable of reacting with silver ions or an active gelatin, selenium sensitization which uses a selenium compound, tellurium sensitization which uses a tellurium compound, reduction sensitization which uses a reducing substance and noble metal sensitization which uses gold or other noble metals; among them, sulfur sensitization, selenium sensitization, tellurium sensitization, reduction sensitization and gold sensitization are preferably used.

Sulfur sensitizers usable in the invention include thiourea derivatives such as 1,3-diphenylthiourea, triethylthiourea, 1-ethyl-3-(2-thiazolyl)thiourea, rhodanine derivatives, dithiacarbamates, polysulfide organic compounds and sulfur itself. When sulfur is used, preferred is α-sulfur which belongs to the orthorhombic system.

Suitable gold sensitizers include chloroauric acid, aurothiosulfate, aurothiocyanate, and gold complexes of various compounds including thioureas and rhodanines.

The content of these sulfur sensitizers or gold sensitizers varies with the kind of silver halide photographic emulsion, the kind of sensitizer used and the ripening conditions, but it is usually $1\times10^{-4}$ to $1\times10^{-9}$ mol and preferably $1\times10^{-5}$ to $1\times10^{-8}$ mol per liter of silver halide.

These sulfur sensitizers and gold sensitizers may be added in the form of solution of water, an alcohol or another inorganic or organic solvent, or in the form of dispersion obtained through a dispersing process which uses a dispersion medium such as a water-insoluble solvent or gelatin.

In the invention, sulfur sensitization and gold sensitization may be carried out jointly and at a time, or separately and stepwise.

Other additives usable in the invention include those described, for example, in RD Nos.17643 (December, 1978), 18716 (November, 1979) and 308119 (December, 1989).

Selenium sensitization employs a variety of selenium compounds as sensitizers, examples of which can be seen, for example, in U.S. Pat. Nos. 1,574,944, 1,602,592, 1,623,499, Japanese Pat. O.P.I. Pub. Nos. 150046/1985, 25832/1982, 109240/1992, 147250/1992. Useful selenium sensitizers include colloidal selenium metal, isoselenocyanates such as allyl isoselenocyanate; selenoureas such as N,N-dimethylselenourea, N,N,N'-triethylselenourea, N,N,N'-trimethyl-N'-heptafluoroselenourea, N,N,N'-trimethyl-N'-4-nitrophenylcarbonylselenourea; selenoketones such as selenoacetone, selenoacetophenone; selenoamides such as selenoacetamide, N,N-dimethylselenobenzamide; selenocarboxylic acids and selenoesters such as 2-selenopropionic acid, methyl-3-selenobutylate; selenophosphates such as trip-triselenophosphate; and selenides such as diethyl selenide, diethyl diselenide. Particularly preferred selenium sensitizers are selenoureas, selenoamides and selenoketones.

Application techniques of these selenium sensitizers can be seen, for example, in U.S. Pat. Nos. 1,579,944, 1,602,592, 1,623,499, 3,297,446, 3,297,447, 3,320,069, 3,408,196, 3,408,197, 3,442,653, 3,420,670, 3,591,385, French Pat. Nos. 2,693,038, 2,093,209, Japanese Pat. Exam. Pub. Nos. 34491/1977, 34492/1977, 295/1978, 22090/1982, Japanese Pat. O.P.I. Pub. Nos. 180536/1984, 185330/1984, 181337/1984, 187338/1984, 192241/1984, 150046/1985, 151637/1985, 246738/1986, 4221/1991, 24537/1991, 111838/1991, 116132/1991, 148648/1991, 237450/1991, 16838/1992, 25832/1992, 32831/1992, 96059/1992, 109240/1992, 140738/1992, 140736/1992, 147250/1992, 149437/1992, 184331/1992, 190225/1992, 191729/1992, 195035/1992 and British Pat. Nos. 255,846, 861,984. Description relevant to the application can also be found in H. E. Spencer et al., Journal of Photographic Science, Vol.31, pp.158–169 (1983).

Though the amount of selenium sensitizers used varies with the types of selenium compound and silver halide grains as well as conditions of chemical ripening, it is usually in a range of $10^{-8}$ to $10^{-4}$ mol per mol of silver halide. These sensitizers may be added, according to the characteristics of the selenium compound contained, by a method which dissolves them in water or in an organic solvent such as methanol or ethanol or a mixture thereof prior to addition, a method which mixes them with a gelatin solution prior to addition, or a method like one disclosed in Japanese Pat. O.P.I. Pub. No. 140739/1992 which adds them in the form of dispersion of a solution containing the sensitizer and a polymer soluble in organic solvents.

The chemical ripening using a selenium sensitizer is carried out at a temperature of preferably 40° to 90° C., more preferably 45° to 80° C. The pH is in a range of preferably 4 to 9, and the pAg is in a range of preferably 6 to 9.5.

Tellurium sensitization and tellurium sensitizers are disclosed, for example, in U.S. Pat. Nos. 1,623,499, 3,320,069, 3,772,031, 3,531,289, 3,655,394, British Pat. Nos. 235,211, 1,121,496, 1,295,462, 1,396,696, Canadian Pat. No. 800,958 and Japanese Pat. O.P.I. Pub. Nos. 204640/1992, 333043/1992. Usable tellurium sensitizers include telluroureas such as N,N-dimethyltellurourea, tetramethyl tellurourea, N-carboxyethyl-N,N'-dimethyltellurourea, N,N'-dimethyl-N'phenyltellurourea; phosphine tellurides such as tributylphosphine telluride, tricyclohexylphosphine telluride, triisopropylphosphine telluride, butyldiisopropylphosphine telluride, dibutylphenylphosphine telluride; telluroamides such as telluroacetamide, N,N-dimethyltellurobenzamide; telluroketones; telluroesters; and telluroisocyanates.

These tellurium sensitizers can be used in nearly the same manner as the selenium sensitizers.

In another preferred embodiment of the invention, chemical sensitization is performed by reduction sensitization, in which silver halide grains are placed in a reducing atmosphere to form reduction-sensitized specks in the inner portion and/or on the surface of the grains.

Preferred reducing agents include thiourea dioxide, ascorbic acid and its derivatives; other preferred reducing agents include polyamines such as hydrazine, diethylenetriamine; dimetylamine; boranes and sulfites.

Preferably, the amount of reducing agent added is varied with the sensitizing conditions such as type of reducing sensitizer, size, composition and crystal habit of silver halide grains, and temperature, pH and pAg of reaction system. When thiourea dioxide is used, favorable results can be obtained with the amount of about 0.01 to 2 mg per mol of silver halide, and ascorbic acid is preferably used in an amount of about 50 mg to 2 g per mol of silver halide.

Preferably, reduction sensitization is carried out under the conditions of temperature: about 40° to 70° C., time: about 10 to 200 minutes, pH: about 5 to 11, and pAg: about 1 to 10 (where the pAg value is a reciprocal value of $Ag^+$ ion concentration).

Nitrates are preferably used as water-soluble silver salts. With the addition of water-soluble silver salts, the so-called silver ripening, one of the reduction-sensitizing techniques, takes place. During silver ripening, the pAg is maintained in a range of usually 1 to 6 and preferably 2 to 4; the temperature, pH and time are preferably the same as the above reduction sensitization conditions. To stabilize the silver halide photographic emulsion containing reduction-sensitized silver halide grains, the usual stabilizers described later can be used. When these stabilizers are used jointly with the anti-oxidant disclosed in Japanese Pat. O.P.I. Pub. No. 82831/1982 and/or the thiosulfones described in V. S. Gahler, Zeitshrift für Wissenschaftliche Photograpie Bd., 63, 133 (1969) and Japanese Pat. O.P.I. Pub. No. 1019/1979, better results can often be produced. Addition of these compounds may be made anytime in the course of emulsion manufacture starting with grain growth and ending with preparation of an emulsion coating solution.

High sensitivity, high sharpness and low dye-staining property can be given to a light-sensitive material by incorporating a dye, which is capable of being decolered or/and washed out in developing process, at least in any one of either the layers containing the light-sensitive silver halide photographic emulsion of the invention or the component layers other than said emulsion layers. For this purpose, a suitable dye can be selected from those which improve the sharpness by absorbing unnecessary wavelength light to eliminate its adverse effect on a light-sensitive material. It is desired that said dye be decolored or washed out in development and leave no coloring on visual inspection after completion of images.

Examples of the dye usable in the light-sensitive material of the invention can be seen in German Pat. No. 616,007, British Pat. Nos. 584,609, 1,177,429, Japanese Pat. Exam. Pub. Nos. 7777/1951, 22069/1964, 38129/1969, Japanese Pat. O.P.I. Pub. Nos. 85130/1973, 99620/1974, 114420/1974, 129537/1974, 28827/1975, 108115/1977, 185038/1982, U.S. Pat. Nos. 1,878,961, 1,884,035, 1,912,797, 2,098,891, 2,150,695, 2,274,782, 2,298,731, 2,409,612, 2,461,484, 2,527,583, 2,533,472, 2,865,752, 2,956,879, 3,094,418, 3,125,448, 3,148,187, 3,177,078, 3,247,127, 3,260,601, 3,282,699, 3,409,433, 3,540,887, 3,575,704, 3,653,905, 3,718,472, 3,865,817, 4,070,352, 4,071,312, PB Report No. 74175 and PHOTO. ABS.1, 28('21).

Preferred examples of the dye usable in the light-sensitive material of the invention are shown below, but dyes usable in the invention are not limited to them.

Exemplified Compounds
(FD-1)
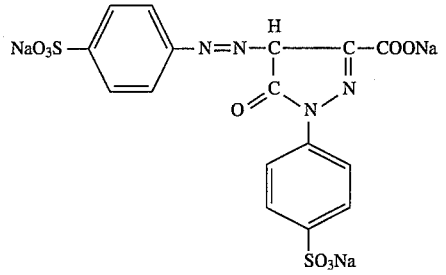
(FD-2)
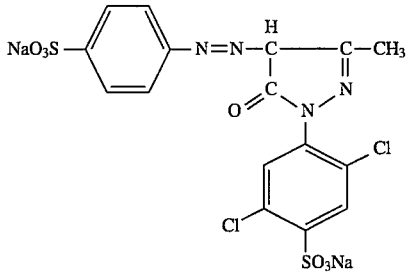
(FD-3)
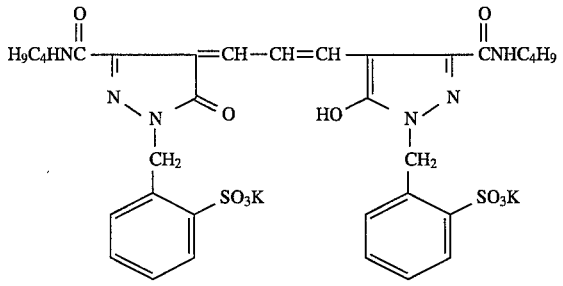
(FD-4)
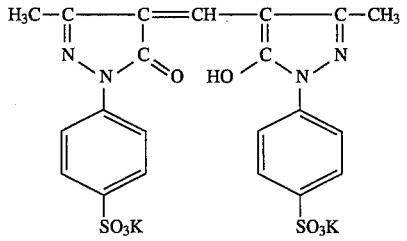
(FD-5)
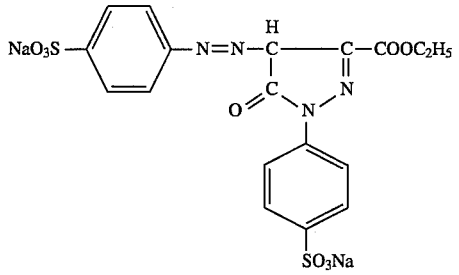
(FD-6)
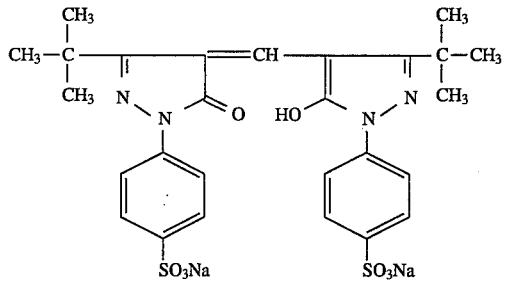

-continued
Exemplified Compounds
(FD-7)
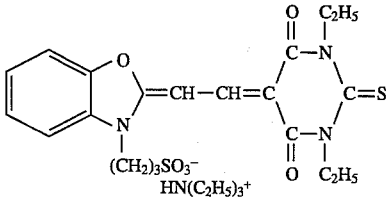
(FD-8)
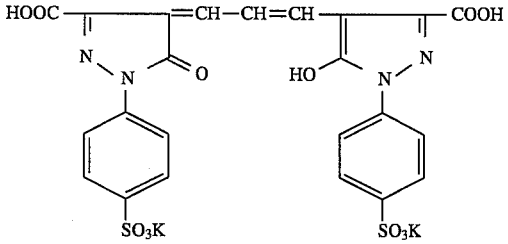
(FD-9)
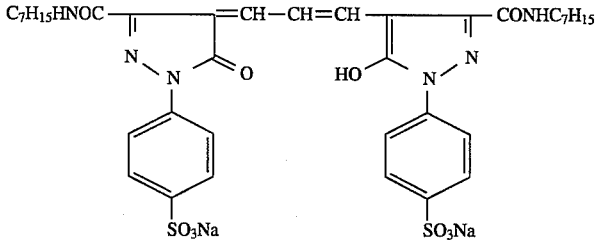
(FD-10)
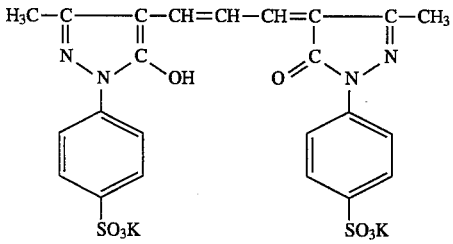
(FD-11)
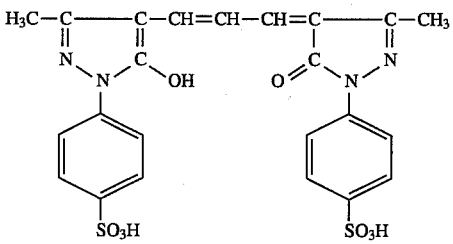
(FD-12)
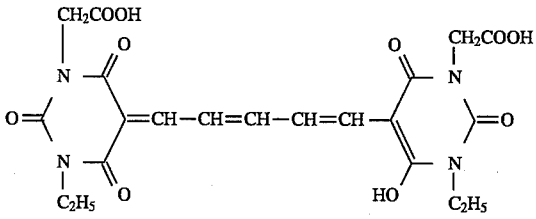

-continued
Exemplified Compounds
(FD-13)
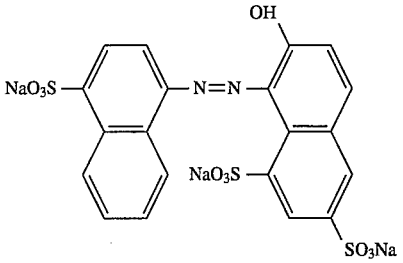
(FD-14)
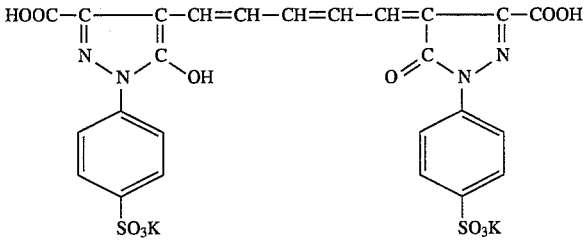
(FD-15)
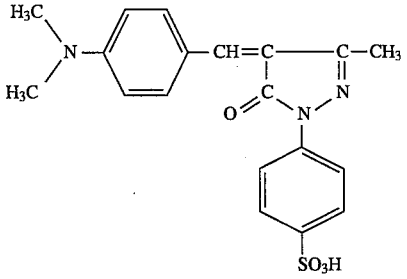
(FD-16)
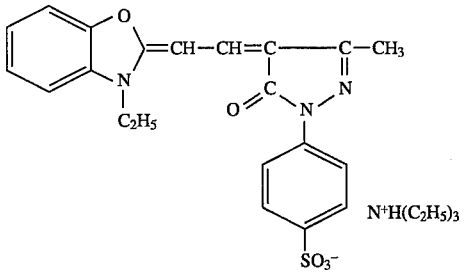
(FD-17)
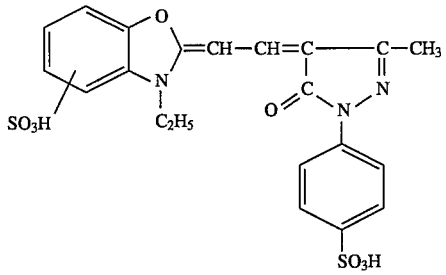
(FD-18)
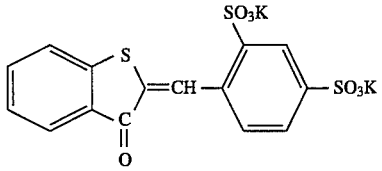

-continued

Exemplified Compounds

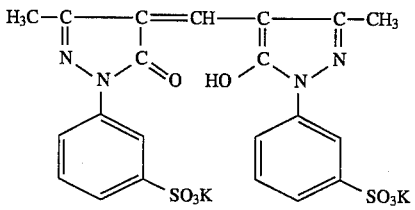

(FD-19)

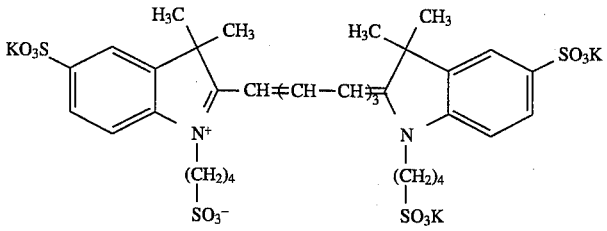

(FD-20)

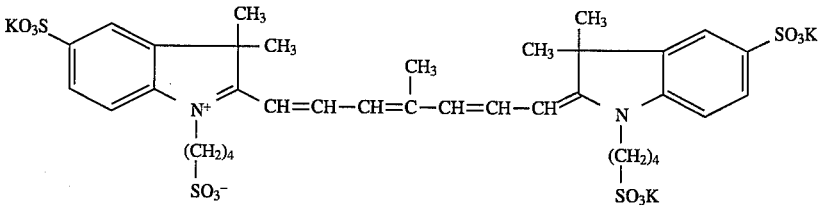

(FD-21)

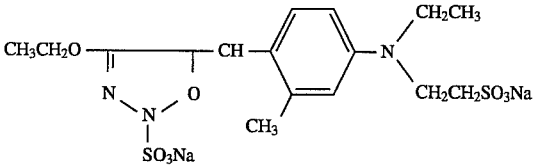

(FD-22)

The dyes exemplified above can be synthesized according to the methods described, for example, in British Pat. No. 560,2385, U.S. Pat. No. 1,884,035 and Japanese Pat. Exam. Pub. No. 22069/1964.

In the invention, the component layer in which the dye is incorporated may be any component layer of the light-sensitive material; that is, the dye may be incorporated at least in one of either the light-sensitive emulsion layers to constitute the light-sensitive material or the other hydrophilic colloid layers (for example, nonlight-sensitive layers such as an intermediate layer, a protective layer and a subbing layer) provided on the same side as the emulsion layers. Preferably, the dye is incorporated in a silver halide photographic emulsion layer, a layer nearer to the support than said emulsion layer, or both of these layers; more preferably, the dye is added to the coating layer adjacent to the transparent support. Further, it is preferred that the concentration of the dye be higher at a position nearer to the support.

In the embodiment of the invention, the amount of the dye added is varied with the level of desired sharpness, but it is preferably 0.2 to 30 mg/m$^2$, more preferably 0.8 to 15 mg/m$^2$.

The dye can be introduced into a hydrophilic colloid layer by the usual method; that is, the dye can be introduced in the form of aqueous solution with a proper concentration or dispersion of solid fine particles. The description in Japanese Pat. O.P.I. Pub. Nos. 158430/1989, 115830/1990 and 251838/1992 may be of help in carrying out the addition.

When a silver halide photographic emulsion layer is colored in the manufacture of light-sensitive material of the invention, a dye is added to a silver halide photographic emulsion, or to an aqueous solution of hydrophilic colloid, and these liquids are coated, in various manners, on a support directly or via another hydrophilic colloid layer.

Since it is desired to make the concentration of dye higher at a position nearer to the support as stated above, a mordant is preferably employed for the purpose of fixing the dye at a position nearer to the support. Suitable mordants, which can combine with at least one of the above dyes, are nondiffusible mordants, examples of which can be seen, for example, in German Pat. No. 2,263,031, British Pat. Nos. 1,221,131, 1,221,195, Japanese Pat. O.P.I. Pub. Nos. 47624/1975, 71332/1975, Japanese Pat. Exam. Pub. No. 1418/1976, U.S. Pat. Nos. 2,548,564, 2,675,316, 2,795,519, 2,839,401, 2,882,156, 3,048,487, 3,184,309, 3,444,138, 3,445,231, 3,706,563, 3,709,690, 3,788,855.

Typical examples are those exemplified below, but compounds usable in the invention are not limited to them.

Exemplified Compounds

1.

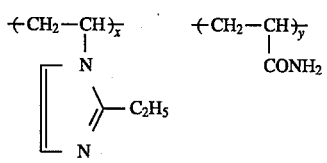

x:y = 25:75

-continued
Exemplified Compounds
2.
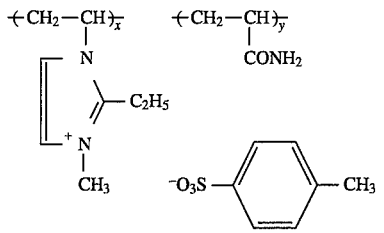
x:y = 25:75
3.
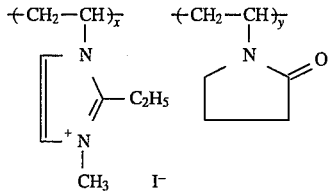
x:y = 66.7:33.3
4.
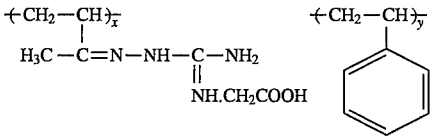
x:y = 66.7:33.3
5.
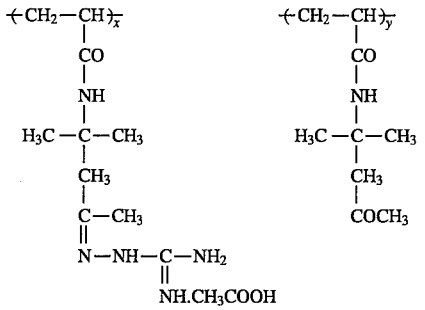
x:y = 75:25
6.
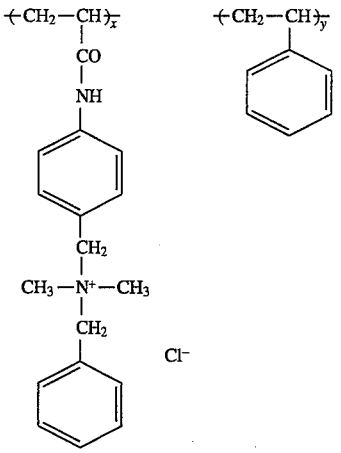
-continued
Exemplified Compounds
x:y = 50:50
7.
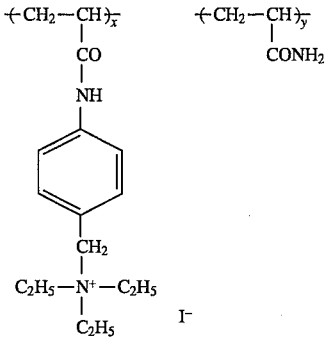
x:y = 50:50
8.
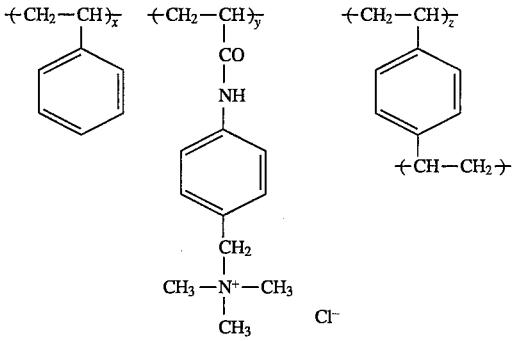
x:y:z: = 48:48:4
9.
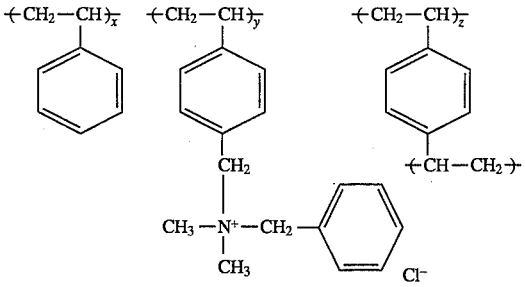
x:y:z: = 49:49:2
10.
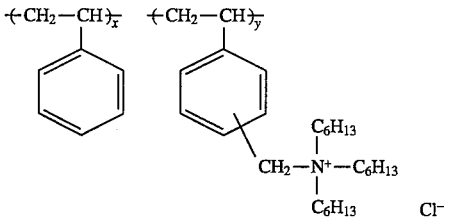
x:y = 50:50

-continued

Exemplified Compounds

11.

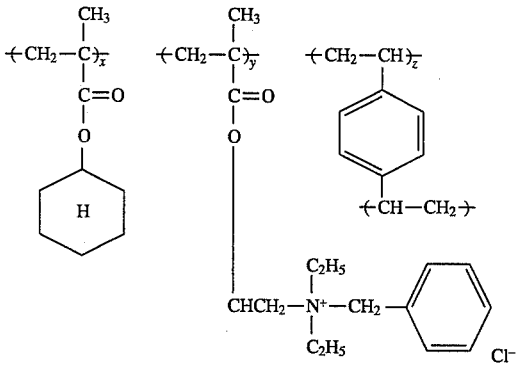

x:y:z = 48:48:2

These compounds can be easily synthesized according to the methods described in Japanese Pat. Exam. Pub. Nos. 15820/1974, 1418/1976, Japanese Pat. O.P.I. Pub. Nos. 73440/1976, 129034/1978, 74430/1979, 155835/1979, 22766/1980.

In the embodiment of the invention, the nondiffusible mordant and the dye can combined in various methods known in the industry. Preferred is a method which combines them in a gelatin binder. There can also be used a method comprising the steps of combining them in a suitable binder and dispersing it into an aqueous solution of gelatin by means of supersonic waves, etc.

The combining ratio varies with the types of compounds, but usually 1 part of water-soluble dye is combined with 0.1 to 10 parts of nondiffusible mordant. Since the water-soluble dye is combined with the nondiffusible mordant, the dye can be employed in an amount larger than when it is used singly.

In the introduction of them into the light-sensitive material, a component layer containing a combined matter of dye and mordant may be provided as an additional layer. Though such a component layer may be formed at any position, it is preferably provided as a coating layer adjacent to the transparent support.

The silver halide photographic light-sensitive material of the invention, or a silver halide photographic light-sensitive material containing the light-sensitive silver halide photographic emulsion of the invention, is used, for example, as a black-and-white silver halide photographic light-sensitive material (e.g., medical light-sensitive material, light-sensitive material for printing, negative light-sensitive material for general photograph), a color photographic light-sensitive material (e.g., color negative light-sensitive material, color reversal light-sensitive material, light-sensitive material for color printing), a light-sensitive material for diffusion transfer and a light-sensitive material for thermal development. Among these applications, the black-and-white silver halide photographic light-sensitive material is preferred, and the medical light-sensitive is particularly preferred.

For the silver halide photographic emulsion layer of the invention, it is preferred that the swelling index in processing be in a range of 150 to 250%, and that the thickness after swelling be not more than 70 μm. When the swelling index in water exceeds 250%, troubles may arise in conveyance in processing with an automatic processor, particularly in rapid processing. On the other hand, a swelling index smaller than 150% tends to cause uneven development and residual coloring. "Swelling index in water" is determined by calculating the difference between the thickness before processing and the swelling thickness in processing solutions, dividing the difference by the thickness before processing and multiplying the quotient by 100.

The method for processing the medical radiographic silver halide photographic light-sensitive material of the invention is a method for processing a silver halide photographic light-sensitive material containing the silver halide photographic emulsion of the invention within a total processing time of 15 to 90 seconds, in a process comprising a processing bath containing no hardener.

In manufacturing a silver halide photographic light-sensitive material using the light-sensitive silver halide photographic emulsion of the invention, a variety of additives are added as necessary to the light-sensitive silver halide photographic emulsion. Examples of such additives and the likes include those described in RD Nos. 17643 (December, 1978), 18716 (November, 1979) and 308119 (December, 1989). Locations of relevant description are as follows:

| | RD-17643 | | RD-18716 | | RD-308119 | |
|---|---|---|---|---|---|---|
| Additives | Page | Class | Page | Class | Page | Class |
| Chemical sensitizers | 23 | III | 648 | upper right | 996 | III |
| Sensitizing dyes | 23 | IV | 648–649 | | 996–8 | IV |
| Desensitizing dyes | 23 | IV | | | 998 | IV |
| Dyes | 25–6 | VIII | 649–650 | | 1003 | VIII |
| Developing accelerators | 29 | XXI | 648 | upper right | | |
| Antifoggants, stabilizers | 24 | IV | 649 | upper right | 1006–7 | VI |
| Whitening agents | 24 | V | | | 998 | V |
| Hardeners | 26 | X | 651 | left | 1004–5 | X |
| Surfactants | 26–7 | XI | 650 | right | 1005–6 | XI |
| Antistatic agents | 27 | XII | 650 | right | 1006–7 | XIII |
| Plasticizers | 27 | XII | 650 | right | 1006 | XII |
| Lubricants | 27 | XII | | | | |
| Matting agents | 28 | XVI | 650 | right | 1008–9 | XVI |
| Binders | 26 | XXII | | | 1003–4 | IX |
| Supports | 28 | XVII | | | 1009 | XVII |

Further, this silver halide photographic material may contain, in its emulsion layer or another layer, a developing agent such as aminophenol, ascorbic acid, pyrocatechol, hydroquinone, phenylenediamine or 3-pyrazolidone.

As supports for the light-sensitive material of the invention, there may be used the materials described on Page 28 of RD No. 17643 and on Page 1009 of RD No. 308119.

Preferred supports are plastic films. In order to improve adhesion to a coating layer, these supports may have a subbing layer or may be subjected to corona discharge or ultraviolet ray irradiation on the surface.

Next, preferred development of the light-sensitive material of the invention is described.

Developers for the light-sensitive material of the invention preferably contain, as developing agents, dihydroxybenzenes such as hydroquinone; p-aminophenols such as p-aminophenol, N-methyl-p-aminophenol, 2,4-diaminophenol; and 3-pyrazolidones such as 1-phenyl-3-pyrazolidones, 1-phenyl-4-methyl-4-hydroxymethyl-3-pyrazolodone, 5,5-dimethyl-1-phenyl-3-pyrazolidone, which are described in Japanese Pat. O.P.I. Pub. Nos. 15641/1992, 16841/1992. Combination of them is also preferred.

These p-aminophenols and 3-aminopyrazolidones are used in an amount of preferably 0.004 to 0.5 mol/liter and more preferably 0.04 to 0.12 mol/liter.

Further, it is preferred that the total amount of dihydroxybenzenes, p-aminophenols and 3-pyrazolidones contained in the whole developing solution be not more than 0.1 mol/liter.

Suitable preservatives may include sulfites such as potassium sulfite, sodium sulfite and reductones such as piperidinohexose reductone, which are used in an amount of preferably 0.2 to 1 mol/liter and more preferably 0.3 to 0.6 mol/liter. Using a large amount of ascorbinates also improves the stability of processing.

Usable alkali agents include pH adjustors such as sodium hydroxide, potassium hydroxide, sodium carbonate, potassium carbonate, trisodium phosphate and tricalcium phosphate. There may also be used buffers such as the borates described in Japanese Pat. O.P.I. Pub. No. 28708 and saccharose, acetoxime, 5-sulfosalicylates, phosphates and carbonates. The content of these chemical is chosen so as to give a pH of 9.0 to 13, preferably 10 to 12.5.

As dissolution auxiliaries, polyethylene glycols and their esters are used. Developing accelerators, such as quaternary ammonium salts, and surfactants can be used as sensitizers.

Preferred silver sludge inhibitors include the silver stain inhibitors disclosed in Japanese Pat. O.P.I. Pub. No. 106244/1981, the sulfide and disulfide compounds described in Japanese Pat. O.P.I. Pub. No. 51844/1991, the cysteine derivatives described in Japanese Pat. Appl. No. 92947/1992 and triazine compounds.

Suitable organic inhibitors include azole-type organic antifoggants such as indazole-type, imidazole-type, benzimidazole-type, triazole-type, benzotriazole-type, tetrazole-type and thiadiazole-type compounds.

Suitable inorganic inhibitors include sodium bromide, potassium bromide, potassium iodide, etc. There may also be used those described in L. F. A. Mason, Photographic Processing Chemistry, pp.226–229, Focal Press (1966), U.S. Pat. Nos. 2,193,015, 2,592,364 and Japanese Pat. O.P.I. Pub. No. 64933/1973. As chelating agents to suppress calcium ions contained in city water used in processing solutions, the chelating agents disclosed in Japanese Pat. O.P.I. Pub. No. 193853/1989, which have a chelate stability constant of 8 or more against iron, are favorably used as organic chelating agents. Usable inorganic chelating agents include sodium hexametaphosphate, calcium hexametaphosphate and polyphosphates.

As development hardeners, dialdehyde compounds may be used. Of them, preferred is glutaldehyde. Further, the developer need not contain a hardener.

The processing temperature with the developer of the invention is in a range of preferably 25° to 50° C., more preferably 30° to 40° C. The developing time is in a range of preferably 5 to 90 seconds and more preferably 8 to 60 seconds. The total processing time ranges preferably from 20 to 210 seconds and more preferably from 20 to 90 seconds in terms of dry to dry.

In the invention, replenishing is carried out to make up for the loss of processing agents caused by exhaustion and oxidation. In practice, there may be used the replenishing according to the width and feed speed of a photographic material as described in Japanese Pat. O.P.I. Pub. No. 126243/1980, the area replenishing as described in Japanese Pat. O.P.I. Pub. No. 104946/1985 or the area replenishing controlled by the number of continuously processed rolls or sheets as described in Japanese Pat. O.P.I. Pub. No. 149156/1989. The replenishing rate is preferably 500 to 150 ml/m$^2$.

Fixers used in the invention can contain fixing materials generally used in the industry. The pH is usually not less than 3.8 and preferably 4.2 to 5.5.

Suitable fixing agents are thiosulfates such as ammonium thiosulfate, sodium thiosulfate, etc.; of them, ammonium thiosulfate is preferred for reasons of fixing speed. The concentration of said ammonium thiosulfate is in a range of preferably 0.1 to 5 mol/liter and more preferably 0.8 to 3 mol/liter.

The fixer of the invention may be one capable of performing acid hardening. In this case, the aluminum ion is preferred as a hardener and used generally in the form of aluminum sulfate, aluminum chloride or potassium alum.

In addition to the above, the fixer of the invention may contain, when necessary, preservatives such as sulfites and bisulfites, pH buffers such as acetic acid and boric acid, pH adjusters including acids such as mineral acids (sulfuric acid, nitric acid and hydrochloric acid) and organic acids (citric acid, oxalic acid, malic acid, etc.) and metal hydroxides (potassium hydroxide, sodium hydroxide, etc.), and chelating agents to soften water.

Usable fixing accelerators include the thiourea derivatives described in Japanese Pat. Exam. Pub. Nos. 35754/1970, 122535/1983 and 122536/1983 and the thioethers described in U.S. Pat. No. 4,126,459.

EXAMPLES

The invention is hereinafter described with examples, but the scope of the invention is by no means limited to these examples.

EXAMPLE 1

Preparation of Seed Emulsion-1

Seed emulsion-1 was prepared in the following manner.

| | |
|---|---|
| Solution A1 | |
| Ossein gelatin | 100 g |
| Potassium bromide | 2.05 g |
| Water was added to made up to | 11.5 liter |
| Solution B1 | |
| Ossein gelatin | 55 g |
| Potassium bromide | 65 g |
| Potassium iodide | 1.8 g |
| 0.2N sulfuric acid | 38.5 ml |
| Water was added to make up to | 2.6 liter |
| Solution C1 | |
| Ossein gelatin | 75 g |
| Potassium bromide | 950 g |
| Potassium iodide | 27 g |
| Water was added to make up to | 3.0 liter |
| Solution D1 | |
| Silver nitrate | 95 g |
| Water was added to make up to | 2.7 liter |
| Solution E1 | |
| Silver nitrate | 1410 g |
| Water was added to make up to | 3.2 liter |

To solution A1 kept at 60° C. in a reaction vessel were added solutions B1 and D1 in 30 minutes by the controlled double-jet method. Then, solutions C1 and E1 were added thereto in 105 minutes by the controlled double-jet method. During the addition, the stirring rate was 500 rpm, and the flow was controlled to a rate corresponding to the growth of grains, not to form new nuclei and not to widen the grain size distribution by having the grains undergo the Ostwald ripening. Further, the pAg was adjusted to 8.3±0.05 with a potassium bromide solution, and the pH was adjusted to 2.0±0.1 with sulfuric acid.

After completion of the addition, the resultant emulsion was adjusted to pH 6.0 and subjected to desalting to remove excess salts according to the method described in Japanese Pat. Exam. Pub. No. 16086/1960.

Observations by electron microscopy indicated that this emulsion comprised monodispersed tetradecahedral grains, of slightly rounded cube form, having an average grain size of 0.27 μm and an extent of grain size distribution of 17%.

Using seed emulsion-1 and the following 7 solutions, a monodispersed core/shell-type emulsion was prepared.

| | |
|---|---|
| Solution A2 | |
| Ossein gelatin | 10 g |
| Aqueous ammonia (28%) | 28 ml |
| Glacial acetic acid | 3 ml |
| Seed emulsion-1 | equivalent to 0.119 mol |
| Water was added to make up to | 600 ml |
| Solution B2 | |
| Ossein gelatin | 0.8 g |
| Potassium bromide | 5 g |
| Potassium iodide | 3 g |
| Water was added to make up to | 110 ml |
| Solution C2 | |
| Ossein gelatin | 2 g |
| Potassium bromide | 90 g |
| Water was added to make up to | 240 ml |
| Solution D2 | |
| Silver nitrate | 9.9 g |
| Aqueous ammonia (28%) | 7.0 ml |
| Water was added to make up to | 110 ml |
| Solution E2 | |
| Silver nitrate | 130 g |
| Aqueous ammonia (28%) | 100 ml |
| Water was added to make up to | 240 ml |
| Solution F2 | |
| Potassium bromide | 94 g |
| Water was added to make up to | 165 ml |
| Solution G2 | |
| Silver nitrate | 9.9 g |
| Aqueous ammonia (28%) | 7.0 ml |
| Water was added to make up to | 110 ml |

Solution A2 was kept at 40° C. and stirred with a stirrer at 800 rpm. After adjusting its pH to 9.90 with acetic acid, seed emulsion-1 was added thereto and dispersed, and then solution G2 was added in 7 minutes at a constant rate to make the pAg 7.3. Further, solutions B2 and D2 were simultaneously added in 20 minutes with the pAg kept at 7.3. After adjusting the pH to 8.83 and the pAg to 9.0 in 10 minutes with the addition of a potassium bromide solution and acetic acid, solutions C2 and E2 were simultaneously added in 30 minutes.

During the addition, the flow rate was raised with the elapse of time so as to make the ratio of initial flow rate to final flow rate 1:10, and the pH was reduced from 8.83 to 8.00 in inverse proportion to the flow rate. When solutions C2 and E2 were added by ⅔ of their total volume, the addition of solution F2 was started and continued for 8 minutes at a constant rate to finish the addition of this solution, during which the pAg was raised from 9.0 to 11.0. Then, the pH was adjusted to 6.0 with the addition of acetic acid.

After completion of the addition, the resultant emulsion was subjected to precipitation desalting using an aqueous solution of Demol (product of Kao-Atlas Co.,Ltd.) and an aqueous solution of magnesium sulfate. The emulsion thus obtained had an average silver iodide content of about 2 mol %, a pAg value of 8.5 and a pH value of 5.85 at 40° C.

Electron microscopic observations of the emulsion indicated that it comprised monodispersed tetradecahedral core/shell-type grains, of rounded cube form, having an average grain size of 0.55 μm and an extent of grain size distribution of 14%.

Preparation of Seed Emulsion-2

Seed emulsion-2 was prepared as follows:

| | |
|---|---|
| Solution A3 | |
| Ossein gelatin | 24.2 g |
| Water | 9657 ml |
| Sodium polypropyleneoxy-polyethyleneoxy-disuccinate (10% ethanol solution) | 6.78 ml |
| Potassium bromide | 10.8 g |
| 10% Nitric acid | 114 ml |
| Solution B3 | |
| 2.5N Silver nitrate aqueous solution | 2825 ml |
| Solution C3 | |
| Potassium bromide | 824 g |
| Potassium iodide | 23.5 g |
| Water was added to make up to | 2825 ml |

Solution D3

1.75N Potassium bromide aqueous solution amount to control the following silver potential Using the mixing stirrer shown in Japanese Pat. Exam. Pub. Nos. 58288/1983 and 58289/1983, 464.3 ml each of solutions B3 and C3 were added at 42° C. in 1.5 minute by the double-jet mixing method to solution A3 to form nuclei.

After stopping the addition of solutions B3 and C3, the temperature of solution A3 was raised to 60° C. in 60 minutes. After adjusting the pH to 5.0 with 3% KOH solution, solutions B3 and C3 were added again by the double-jet mixing method in 42 minutes at flow rates of 55.4 ml/min, respectively. The silver potentials (measured with a silver ion selection electrode using a saturated silver-silver chloride electrode as a reference electrode) during the temperature rise from 42° C. to 60° C. and during the simultaneous readdition of solutions B3 and C3 were controlled at +8 mv and +16 mv, respectively, by use of solution D3.

After completion of the addition, the resultant emulsion was adjusted to pH 6 with 3% KOH solution and immediately subjected to desalting and washing.

Electron microscopic observations proved that more than 90% of the total projected area of silver halide grains was accounted for by hexagonal tabular gains having a side length ratio of 1.0 to 2.0, an average thickness of 0.06 μm and an average grain size (diameter of an equivalent circle) of 0.59 μm. The variation coefficient of the thickness was 40% and the variation coefficient of the intertwin-plane distance was 42%.

Preparation of Em-2

Using seed emulsion-2 and the following 3 solutions, a tabular emulsion, Em-2, was prepared.

| | |
|---|---|
| Solution A4 | |
| Ossein gelatin | 5.26 g |
| Sodium polypropyleneoxy- | 1.4 ml |

-continued

| | |
|---|---|
| polyethyleneoxy-disuccinate (10% ethanol solution) | |
| Seed emulsion-2 | equivalent to 0.094 mol |
| Water was added to make up to | 569 ml |
| Solution B4 | |
| Ossein gelatin | 15.5 g |
| Potassium bromide | 14 g |
| Potassium iodide | 3.19 g |
| Water was added to make up to | 658 ml |
| Solution C4 | |
| Silver nitrate | 166 g |
| Water was added to make up to | 889 ml |

While solution A4 was vigorously stirred at 60° C., solutions B4 and C4 were added by the double-jet method in 107 minutes. During the addition, the reaction system was kept at pH 5.8 and pAg 8.7, and the flow rates of solutions B4 and C4 were linearly raised so as to increase the final flow rates to 6.4 times the initial flow rates, respectively. After completion of the addition, the resultant emulsion was subjected to coagulation desalting using an aqueous solution of Demol (product of Kao-Atlas Co.,Ltd.) and an aqueous solution of magnesium sulfate. The emulsion thus obtained had an average silver iodide content of about 2 mol %, a pAg value of 8.5 and a pH value of 5.85 at 40° C.

Observations of this emulsion by electron microscopy indicated that 82% of the total projected area of the grains cam e from tabular silver halide grains having an average grain size of 0.98 μm, an extent of grain size distribution of 18% and an average aspect ratio of 4.5. Further, the average of the longest distances between twin planes (a) was 0.006 μm, and the variation coefficient of (a) was 42%.

Preparation of Em-3

Emulsion Em-3 was prepared in the same manner as Em-2 except that the mixing temperature during nucleus formation was changed from 42° to 35° C.

Observations of this emulsion by electron microscopy indicated that 84% of the total projected area of the grains came from tabular silver halide grains having an average grain size of 0.98 μm, an extent of grain size distribution of 17% and an average aspect ratio of 4.5. Further, the average of the distances (a) was 0.006 μm, and the variation coefficient of (a) was 30%.

Preparation of Em-4

Emulsion Em-4 was prepared in the same manner as Em-2 except that the mixing time in nucleus formation was changed from 1.5 minute to 2.0 minutes.

Observations of this emulsion by electron microscopy indicated that 84% of the total projected area of the grains was accounted for by tabular silver halide grains having an average grain size of 0.98 μm, an extent of grain size distribution of 18% and an average aspect ratio of 4.5. Further, the average of the distances (a) was 0.020 μm, and the variation coefficient of (a) was 42%.

Preparation of Em-5

Emulsion Em-5 was prepared in the same manner as Em-2 except that the mixing temperature in nucleus formation was changed from 42° to 35° C. and the mixing time was changed from 1.5 minute to 2.0 minutes.

Observations of this emulsion by electron microscopy indicated that the 86% of the total projected area of the grains came from tabular silver halide grains having an average grain size of 0.98 μm, an extent of grain size distribution of 16% and an average aspect ratio of 4.5. Further, the average of the distances (a) was 0.020 μm, and the variation coefficient of (a) was 30%. Incidentally, variation coefficient of thickness of the seed grains was 32%, and the variation coefficient of intertwin-plane distance of seed grains was 29%.

Preparation of Em-6 to Em-8

Emulsions Em-6 to Em-8 were prepared in the same manner as Em-2, except that the amount of KBr in solution A3, mixing temperature and mixing time during the nucleus formation of seed emulsion-2 as well as the pAg in the preparation of Em-2 were changed.

Preparation of Em-9

Using seed emulsion-2 and the following 4 solutions, an emulsion comprising tabular core/shell-type grains was prepared.

| | |
|---|---|
| Solution A5 | |
| Ossein gelatin | 11.7 g |
| Sodium polypropyleneoxy-polyethyleneoxy-disuccinate (10% ethanol solution) | 1.4 ml |
| Seed emulsion-2 | equivalent to 0.10 mol |
| Water was added to make up to | 550 ml |
| Solution B5 | |
| Ossein gelatin | 5.9 g |
| Potassium bromide | 4.6 g |
| Potassium iodide | 3.0 g |
| Water was added to make up to | 145 ml |
| Solution C5 | |
| Silver nitrate | 10.1 g |
| Water was added to make up to | 145 ml |
| Solution D5 | |
| Ossein gelatin | 6.1 g |
| Potassium bromide | 94 g |
| Water was added to make up to | 304 ml |
| Solution E5 | |
| Silver nitrate | 137 g |
| Water was added to make up to | 304 ml |

Solutions B5 and C5 were added in 58 minutes by the double-jet method to solution A5 being stirred vigorously at 70° C. Then, solutions D5 and E5 were added thereto in 48 minutes by the double-jet method with the pH kept at 5.8 and the pAg at 8.7. After completion of the addition, the resultant emulsion was subjected to desalting as emulsion Em-2. The emulsion thus obtained had an average silver iodide content of 2.0 mol %, a pAg value of 8.5 and a pH value of 5.85 at 40° C.

Observations by electron microscopy indicated that 81% of the total projected area of the grains was accounted for by tabular silver halide grains having an average grain size of 96 μm, an extent of grain size distribution of 18% and an average aspect ratio of 4.5. Further, the average of the distances (a), was 0.007 μm and the variation coefficient of (a) was 45%.

Preparation of Em-10 to Em-24

Emulsions Em-10 to Em-24 were prepared in the same manner as Em-3, except that changes were made in the following conditions: the amount of KBr of solution A3 in emulsion-2, and the addition time and addition temperature of solutions B3 and C3 in Em-9; and the amount of seed emulsion-2 in solution A4, the amounts of potassium bromide and potassium iodide in solution B5, and the pAg during addition, addition rate, addition time and addition temperature in the preparation of Em-2.

Table 2 shows the grain shape, iodide content distribution thereof, average grain size, average aspect ratio (AR), average of (a) and variation coefficient thereof, Em-1 to Em-24.

TABLE 2

| Emulsion No. | Grain shape | Iodide content % | Iodide distributuion | Grain size (μm) | Aspect ratio | Distance (a) Average μm | Distance (a) Variation coefficient % | Remarks |
|---|---|---|---|---|---|---|---|---|
| Em-1 | Telradecahedrol | 2.0 | Core/shell | 0.550 | 1.0 | 0.008 | 18 | Comp. |
| Em-2 | Tabular | 2.0 | Uniform | 0.981 | 4.5 | 0.006 | 42 | Comp. |
| Em-3 | Tabular | 2.0 | Uniform | 0.981 | 4.5 | 0.006 | 30 | Comp. |
| Em-4 | Tabular | 2.0 | Uniform | 0.981 | 4.5 | 0.020 | 42 | Comp. |
| Em-5 | Tabular | 2.0 | Uniform | 0.981 | 4.5 | 0.020 | 30 | Inv. |
| Em-6 | Tabular | 2.0 | Uniform | 1.163 | 7.5 | 0.007 | 28 | Comp. |
| Em-7 | Tabular | 2.0 | Uniform | 1.163 | 7.5 | 0.012 | 38 | Comp. |
| Em-8 | Tabular | 2.0 | Uniform | 1.163 | 7.5 | 0.012 | 27 | Inv. |
| Em-9 | Tabular | 2.0 | Core/shell | 0.961 | 4.5 | 0.007 | 45 | Comp. |
| Em-10 | Tabular | 2.0 | Core/shell | 0.961 | 4.5 | 0.007 | 32 | Comp. |
| Em-11 | Tabular | 2.0 | Core/shell | 0.961 | 4.5 | 0.022 | 44 | Comp. |
| Em-12 | Tabular | 2.0 | Core/shell | 0.961 | 4.5 | 0.022 | 33 | Inv. |
| Em-13 | Tabular | 1.0 | Core/shell | 1.113 | 7.7 | 0.007 | 48 | Comp. |
| Em-14 | Tabular | 1.0 | Core/shell | 1.113 | 7.7 | 0.007 | 30 | Comp. |
| Em-15 | Tabular | 1.0 | Core/shell | 1.113 | 7.7 | 0.019 | 39 | Comp. |
| Em-16 | Tabular | 1.0 | Core/shell | 1.113 | 7.7 | 0.019 | 29 | Inv. |
| Em-17 | Tabular | 5.1 | Core/shell | 1.866 | 7.0 | 0.006 | 50 | Comp. |
| Em-18 | Tabular | 5.1 | Core/shell | 1.866 | 7.0 | 0.006 | 30 | Comp. |
| Em-19 | Tabular | 5.1 | Core/shell | 1.866 | 7.0 | 0.025 | 48 | Comp. |
| Em-20 | Tabular | 5.1 | Core/shell | 1.866 | 7.0 | 0.025 | 31 | Inv. |
| Em-21 | Tabular | 0.5 | Core/shell | 0.774 | 4.0 | 0.007 | 45 | Comp. |
| Em-22 | Tabular | 0.5 | Core/shell | 0.774 | 4.0 | 0.007 | 27 | Comp. |
| Em-23 | Tabular | 0.5 | Core/shell | 0.774 | 4.0 | 0.023 | 45 | Comp. |
| Em-24 | Tabular | 0.5 | Core/shell | 0.774 | 4.0 | 0.023 | 24 | Inv. |

*An emulsion which meets requirements of the invention regarding silver halide grains is denoted as "Inv."

Subsequently, these emulsions were subjected to spectral sensitization and chemical sensitization according to the following two recipes:

Recipe A

After adding methanol solutions of spectral sensitizing dyes D-1 and D-10 to an emulsion heated to 60° C., a mixed aqueous solution of ammonium thiocyanate, chloroauric acid and sodium thiosulfate, and a silver iodide fine particle emulsion were added thereto. Then, the mixture was ripened for 2 hours. Upon termination of the ripening, stabilizer 4-hydroxy-6-methyl-1,3,3a,7-tetrazaindene (TAI) was added. Recipe B This is different from recipe A only in the point that the spectral sensitizing dyes were added in the form of dispersions of fine solid particles instead of methanol solutions. Said dispersions were prepared according to the method described in Japanese Pat. O.P.I. Pub. No. 297496/1993; i.e., prescribed amounts of spectral sensitizing dyes D-1 and D-10 were added to water kept at 27° C. and then dispersed by stirring for 30–120 minutes at 3,500 rpm with a dissolver.

The additives and their amounts used in the sensitization are shown below by taking those used in emulsion Em-24 as a typical example. For the other emulsions, corrections were made in proportion to the surface area of silver halide grains.

| | |
|---|---|
| Spectral sensitizing dye D-1 | 450 mg(/mol Ag) |
| Spectral sensitizing dye D-10 | 5 mg |
| Potassium thiocyanate | 95 mg |
| Chloroauric acid | 25 mg |
| Sodium thiosulfate | 25 mg |
| Silver iodide fine particles | 850 mg |
| Stabilizer TAI | 1 g |

When spectral sensitizing dye D-1 was used in the form of dispersions of fine solid particles, 280 mg of the dye was added. This amount gives about the same spectral absorption spectrum as that obtained by the amount of dye used as methanol solutions.

Coating solutions for emulsion layer were prepared by adding the following additives to these emulsions. The following coating solution for protective layer was also prepared. These two coating solutions were simultaneously coated on both sides of a support using two slide hopper-type coaters, so as to give a silver coating weight of 2.0 g/m$^2$ and a gelatin coating weight of 3.1 g/m$^2$ on each side, followed by drying. Thus, sample Nos. 1 to 24 were obtained. The support used here was prepared by coating on both sides of a 175-μm thick polyethylene terephthalate film base for x-ray photography, which was colored with blue to density 0.15, a subbing solution obtained by dispersing the above crossover light filter dye (FD-3) and gelatin in 10 wt % aqueous dispersion of a copolymer comprising 50 wt % glycidyl methacrylate, 10 wt % methyl acrylate and 40 wt % butyl methacrylate.

The additives added to the emulsions are shown below, where the amounts are per mol of silver halide.

Coating Solution for Emulsion Layer

| | |
|---|---|
| 1,1-Dimethylol-1-bromo-1-nitromethane | 70 mg |
| t-Butyl-catechol | 400 mg |
| Polyvinylpyrrolidone (MW: 10,000) | 1.0 g |
| Styrene-maleic anhydride copolymer | 2.5 g |
| Nitrophenyl-triphenylphosphonium chloride | 50 mg |
| Ammonium 1,3-dihydroxybenzene-4-sulfonate | 2.0 g |

-continued

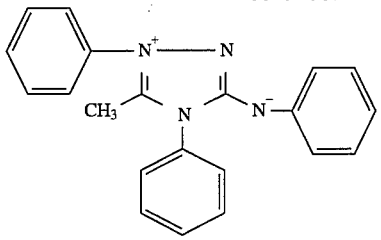

150 mg

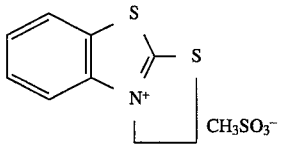

70 mg $C_4H_9OCH_2CH(OH)CH_2N(CH_2COOH)_2$ 1.0 g

1-Phenyl-5-mercapto-tetrazole 15 mg

Coating Solution for Protective Layer

Subsequently, the following coating solution for protective layer was prepared. The amounts of additives used are per liter of coating solution.

| | |
|---|---|
| Lime-processed inert gelatin | 68 g |
| Acid-processed gelatin | 2.0 g |
| Sodium i-amyl-n-decylsulfosuccinate | 1.0 g |
| Polymethyl methacrylate (matting agent with an area average particle size of 3.5 μm) | 1.1 g |
| Silicon dioxide particles (matting agent with an area average particle size of 1.2 μm) | 0.5 g |
| $(CH_2{=}CHSO_2CH_2)_{20}$ (hardener) | 500 mg |
| $C_4F_9SO_3K$ | 2.0 mg |
| $C_{12}H_{25}CONH(CH_2CH_2O)_5H$ | 2.0 g |

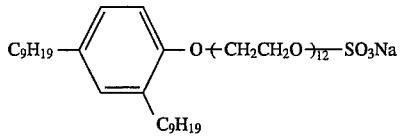

1.0 g

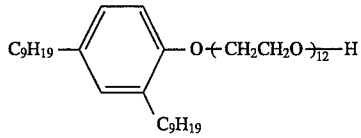

0.4 g

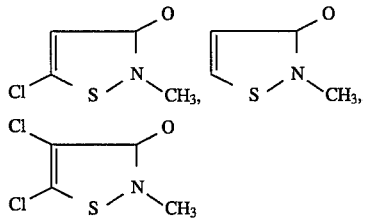

(50:46:4) 0.1 g

Photographic properties of sample Nos. 1 to 24 were evaluated. That is, each of the samples was put between two intensifying screens, exposed by irradiating X-rays of a tube voltage of 80 kvp and a tube current of 100 mA, in 0.05 second through an aluminum wedge and, then, processed in an SRX-502 automatic processor with the developer and fixer of the following recipes.

| | |
|---|---|
| Recipe of the Developer | |
| Part-A (to be made up to 12 liters) | |
| Potassium hydroxide | 450 g |
| Potassium sulfite (50% solution) | 2280 g |
| Diethylenetriaminepentaacetic acid | 120 g |
| Sodium hydrogencarbonate | 132 g |
| 5-Methylbenzotriazole | 1.2 g |
| 1-Phenyl-5-mercapto-tetrazole | 0.2 g |
| Hydroquinone | 340 g |
| Water was added to make up to | 5000 ml |
| Part-B (to be made up to 12 liters) | |
| Glacial acetic acid | 170 g |
| Triethylene glycol | 185 g |
| 1-Phenyl-3-pyrazolidone | 22 g |
| 5-Nitroindazole | 0.4 g |
| Starter | |
| Glacial acetic acid | 120 g |
| Potassium bromide | 225 g |
| Water was added to make up to | 1.0 liter |
| Recipe of the Fixer | |
| Part-A (to be made up to 18 liters) | |
| Ammonium thiosulfate (70 wt %/vol %) | 6000 g |
| Sodium sulfite | 110 g |
| Sodium acetate.3 hydrate | 450 g |
| Sodium citrate | 50 g |
| Gluconic acid | 70 g |
| 1-(N,N'-Dimethylamino)-ethyl-5-mercaptotetrazole | 18 g |
| Part-B (to be made up to 18 liters) | |
| Aluminum sulfate | 800 g |

The developer was prepared by adding part-A and part-B simultaneously to about 5 liters of water, making up the total volume to 12 liters with stirring and adjusting the pH to 10.40 with acetic acid. This was used as a developing replenisher.

A working developer was prepared by adding the above starter to the developing replenisher in an amount of 20 ml/l and then adjusting the pH to 10.26.

A fixing replenisher was prepared by pouring Part-A and Part-B simultaneously into about 5 liters of water, adding water with stirring and adjusting the pH to 4.4 using sulfuric acid and sodium hydroxide.

Processing was carried out at the temperatures of developing: 35° C., fixing: 33° C., washing: 20° C. and drying: 50° C., and the dry to dry processing time was 45 seconds.

The processed samples were subjected to sensitometry, of which results are shown in Table 3. The sensitivity was determined as the reciprocal of an exposure to give a density of fog+0.5 and is shown in the table as a relative sensitivity to the sensitivity of sample I(A) which is set at 100. Sample 1(A) is one belonging to sample 1 and prepared by use of the emulsion sensitized by recipe A.

TABLE 3

| Sample No. | Relative sensitivity A/B*1 | Residual coloring A/B*1 | Pressure fog A/B*1 | Sharpness | Remarks*2 |
|---|---|---|---|---|---|
| 1 | 100/103 | 100/95 | 100/98 | 100/90 | Comp. |
| 2 | 120/125 | 85/78 | 172/169 | 115/110 | Comp. |
| 3 | 130/133 | 88/76 | 132/128 | 113/110 | Comp. |
| 4 | 127/131 | 90/81 | 156/150 | 114/112 | Comp. |
| 5 | 136/145 | 87/68 | 120/115 | 115/114 | Inv. |
| 6 | 164/168 | 80/74 | 138/130 | 120/118 | Comp. |
| 7 | 156/160 | 77/62 | 168/163 | 118/117 | Comp. |
| 8 | 169/177 | 72/59 | 133/124 | 123/121 | Inv. |
| 9 | 115/120 | 92/78 | 136/132 | 114/110 | Comp. |
| 10 | 123/127 | 94/81 | 110/105 | 116/113 | Comp. |
| 11 | 121/125 | 91/77 | 120/115 | 111/107 | Comp. |
| 12 | 129/140 | 88/65 | 85/79 | 117/116 | Inv. |
| 13 | 132/136 | 75/72 | 142/138 | 119/116 | Comp. |
| 14 | 146/150 | 73/66 | 104/100 | 125/122 | Comp. |
| 15 | 143/147 | 77/71 | 128/123 | 124/120 | Comp. |
| 16 | 153/162 | 70/64 | 95/90 | 127/125 | Inv. |
| 17 | 364/370 | 89/87 | 140/135 | 118/114 | Comp. |
| 18 | 405/412 | 88/85 | 105/100 | 122/118 | Comp. |
| 19 | 390/395 | 89/85 | 120/115 | 120/117 | Comp. |
| 20 | 427/440 | 86/77 | 85/78 | 125/123 | Inv. |
| 21 | 77/82 | 91/82 | 136/133 | 114/110 | Comp. |
| 22 | 86/90 | 89/76 | 195/190 | 116/113 | Comp. |
| 23 | 81/85 | 93/84 | 119/115 | 112/108 | Comp. |
| 24 | 93/104 | 87/65 | 83/72 | 118/116 | Inv. |

*1Value A/B means the ratio of the measured value of a sample according to sensitizing recipe A to the measured value of a sample according to sensitizing recipe B.
*2A sample containing an emulsion which meets requirements of the invention regarding silver halide grains is denoted as "Inv."

When comparison is made among emulsions having the same iodide composition, same grain size and same aspect ratio, it is apparent that the samples of the invention are sensitized much higher than those of comparative samples, though the amounts of spectral sensitizing dyes added are smaller.

The residual color of the processed samples was evaluated by measuring the spectral absorption density of each sample at a wavelength of 510 nm using a spectrophotometer and comparing the measured values. In Table 3, the residual color is given in a value relative to the residual color density of sample 1(A) which is set at 100. Sample 1(A) is one coated with the emulsion sensitized by adding the methanol solution of spectral sensitizing dye according to recipe A.

It is apparent from Table 3 that the residual color stain becomes lower when the spectral sensitizing dye is added in the form of dispersion of fine solid particles, instead of adding the dye as a methanol solution.

Evaluation of the pressure characteristics was made by the steps of pressing each unexposed sample at 5 g load with a scratch hardness tester having a 0.3-mm needle point, processing the sample in the same manner as that described above, and measuring the density of pressure fog caused on the sample using a microdensitometer. In Table 3, the degree of fogging is shown in a relative value by setting the increment of fogging in sample I(A) to be 100.

It will be understood from the table that the samples of the invention are less in pressure fogging and thereby suggest improvement in pressure resistance. It can also be understood that particularly preferred results can be obtained in samples which made from an emulsion using a fine solid particle dispersion of spectral sensitizing dye and comprising core/shell type grains.

The sharpness (MTF) was evaluated in the following manner: the MTF value at a spatial frequency of 1.0 cycle/mm was measured using a 30 μm×500 μm aperture, on each processed sample, in a portion where the optical density was 1.0. The sharpness in the table is expressed in a relative value by setting the MTF value of sample 1(A) to be 100.

As is apparent from Table 3, the samples of the invention are high in sensitivity and excellent in sharpness, though the addition of spectral sensitizing dyes is smaller in amounts.

EXAMPLE 2

The emulsions, Em-1 to Em-24, were ripened in the same manner as in Example 1, except that N,N'-dimethyl-selenourea (equivalent to one-fifth the amount of sodium thiosulfate used) was added to recipes A and B in Example 1, as a chemical sensitizer other than those prescribed in the recipes.

Coating solutions for emulsion layer were prepared by adding the additives as in Example 1 to these emulsions. A coating solution for protective layer was also prepared as in Example 1. Sample Nos. 25 to 48 were prepared by coating these coating solutions as in Example 1.

The photographic properties and residual coloring of sample Nos. 25 to 48 were evaluated, i.e., each sample was firstly put between two KO-250 intensifying screens, exposed by irradiating X-rays through an aluminum wedge under conditions of tube voltage: 80 kvp, tube current: 100 mA and irradiation time: 0.05 second, and then processed in an SRX-502 automatic processor using the same developer and fixer as in Example 1, except that the processing time was shortened to 30 seconds by modification of the automatic processor. The evaluation methods were the same as in Example 1.

TABLE 4

| Sample No. | Relative sensitivity A/B*1 | Residual coloring A/B*1 | Remarks*2 |
|---|---|---|---|
| 1 | 100/104 | 100/92 | Comp. |
| 2 | 133/136 | 86/77 | Comp. |
| 3 | 145/150 | 89/76 | Comp. |
| 4 | 140/144 | 92/80 | Comp. |
| 5 | 162/170 | 89/66 | Inv. |
| 6 | 176/180 | 81/74 | Comp. |
| 7 | 170/173 | 78/71 | Comp. |
| 8 | 205/215 | 74/56 | Inv. |
| 9 | 125/127 | 93/77 | Comp. |
| 10 | 132/138 | 95/80 | Comp. |
| 11 | 130/134 | 92/75 | Comp. |
| 12 | 153/165 | 90/64 | Inv. |
| 13 | 144/148 | 79/72 | Comp. |
| 14 | 160/163 | 76/71 | Comp. |
| 15 | 154/159 | 78/72 | Comp. |
| 16 | 185/195 | 73/63 | Inv. |
| 17 | 402/407 | 89/84 | Comp. |
| 18 | 450/453 | 88/84 | Comp. |
| 19 | 425/431 | 90/85 | Comp. |
| 20 | 485/503 | 87/75 | Inv. |
| 21 | 80/84 | 93/85 | Comp. |
| 22 | 96/100 | 91/75 | Comp. |
| 23 | 90/93 | 94/83 | Comp. |
| 24 | 115/124 | 89/64 | Inv. |

*1Ratio of the measured value of a sample of sensitizing recipe A to the measured value of a sample of sensitizing recipe B.
*2A sample containing an emulsion which meets requirements of the invention regarding silver halide grains is denoted as "Inv."

It can be seen from Table 4 that even when the processing time is shortened to 30 seconds, the samples of the invention are higher in sensitivity and less in residual coloring than the comparative samples. This indicates that the advantages of the invention can be demonstrated more clearly in rapid processing.

EXAMPLE 3

Using the above emulsion Em-12, the sensitizing effect by combination of the dyes represented by formula I and that represented by formula II' was examined as follows:

Firstly, coated sample Nos. 25 to 34 were prepared by adding the dyes to Em-12 in the same amounts and combinations as recipe B in Example 1 and using the same steps as in Example 1.

TABLE 5

| Sample No. | Dye I | Amount Added (mg) | Dye II' | Amount Added (mg) | Remarks |
|---|---|---|---|---|---|
| 25 | I-2 | 30 | II'-4 | 250 | Invention |
| 26 | I-2 | 140 | II'-4 | 140 | Invention |
| 27 | I-2 | 250 | II'-4 | 30 | Invention |
| 28 | I-2 | 30 | II'-15 | 250 | Invention |
| 29 | I-2 | 140 | II'-15 | 140 | Invention |
| 30 | I-2 | 250 | II'-15 | 30 | Invention |
| 31 | I-2 | 30 | II'-16 | 250 | Invention |
| 32 | I-2 | 140 | II'-16 | 140 | Invention |
| 33 | I-2 | 250 | II'-16 | 30 | Invention |
| 34 | I-2 | 280 | — | 0 | Comparison |

Subsequently, sample Nos. 25 to 34 were preserved for 4 days under the two different conditions (condition A: 23° C. and RH, condition B: 40° C. and 80% RH) and exposed and processed as in Example 1.

After processing, the photographic properties were evaluated. The results of the evaluation are shown in Table 6, where the sensitivity, which was obtained as a reciprocal of the exposure to give a density of fog+0.5, is shown in a value relative to the sensitivity of sample 34 (preservation condition A) which is set to be 100.

TABLE 6

| Sample | Preservation A | | Preservation B | |
|---|---|---|---|---|
| No. | Fog | Sensitivity | Fog | Sensitivity |
| 25 | 0.011 | 115 | 0.020 | 103 |
| 26 | 0.011 | 130 | 0.018 | 114 |
| 27 | 0.010 | 120 | 0.015 | 115 |
| 28 | 0.012 | 123 | 0.022 | 117 |
| 29 | 0.010 | 134 | 0.019 | 120 |
| 30 | 0.009 | 125 | 0.015 | 118 |
| 31 | 0.011 | 127 | 0.020 | 118 |
| 32 | 0.010 | 140 | 0.018 | 131 |
| 33 | 0.010 | 132 | 0.017 | 126 |
| 34 | 0.009 | 100 | 0.018 | 90.5 |

As can be seen from Table 6, the samples of the invention sensitized by the combination of two types of spectral sensitizing dyes are high in sensitivity and less in fluctuation of sensitivity and fogging even when preserved under conditions of high temperature and high humidity.

Next, the emulsions prepared as above, namely Em-1, Em-5, Em-8, Em-12, Em-16, Em-20 and Em-24, were sensitized with the following two types of sensitizing dyes to evaluate the feature of the technique to use spectral sensitizing dyes jointly. The procedure and results of the evaluation are described below.

Sensitization Recipe P

To a silver halide emulsion kept at 60° C. were added exemplified spectral sensitizing dyes II'-16 and 1-12 in the form of dispersions of fine solid particles. Then, a mixed aqueous solution of ammonium thiocyanate, chloroauric acid and sodium thiosulfate was added thereto and, 60 minutes later, a silver iodide fine grain emulsion was further added; thus, ripening was carried out over a total period of 2 hours. After completion of the ripening, a proper amount of TAI was added as a stabilizer.

The amounts of the above additives added are shown below by taking those for Em-12 as a typical example. For the other emulsions, corrections of amounts were made in proportion to the surface area of silver halide grains.

| | |
|---|---|
| Spectral sensitizing dye II'-16 | 140 mg |
| Spectral sensitizing dye I-2 | 140 mg |
| Potassium thiocyanate | 95 mg |
| Chloroauric acid | 25 mg |
| Sodium thiosulfate | 25 mg |
| Silver iodide fine grains | 850 mg |
| Stabilizer TAI | 1 g |

Sensitization Recipe Q

The same conditions as sensitization recipe P, except that spectral sensitizing dye II'-16 alone was used as a sensitizing dye.

Coated sample Nos. 35 to 41 were prepared by sensitizing the respective emulsions according to the above two sensitizing recipes and then adding the additives to these emulsions in the same manner as in Example 1, followed by coating.

Photographic properties and pressure resistance were evaluated on each sample, the results of which are shown in Table 6.

Photographic Properties

The relative sensitivity shown in the table was determined by setting the sensitivity of sample No. 35 (sensitized by sensitization recipe Q and preserved under preservation condition A) at 100. The preservation stability is shown in a relative value obtained by determining, on each sample, the sensitivity difference between a specimen of preservation condition A and that of preservation condition B and setting the sensitivity difference of sample No. 35 to be 100. In the table, the smaller the value is, the higher the preservation stability is.

Pressure Resistance

The pressure resistance was determined by applying 5 g load to unexposed sample Nos. 35 to 41 (preserved under preservation condition A) with a scratch hardness tester having a 0.3-mm needle point, processing the samples as in Example 1, and measuring the densities of pressure fog caused with a microdensitometer. In the table, the pressure resistance is expressed in a relative value obtained by setting the increment of sample No. 35 (sensitization recipe Q) in fog to be 100.

TABLE 7

| Sample No. | Relative sensitivity P/Q* | Preservation stability P/Q* | Pressure resistance P/Q* | Remarks Em. No. |
|---|---|---|---|---|
| 35 | 110/100 | 65/100 | 88/100 | Em-1 |
| 36 | 162/140 | 52/95 | 104/115 | Em-5 |
| 37 | 212/177 | 45/103 | 111/124 | Em-8 |
| 38 | 188/138 | 26/75 | 70/79 | Em-12 |
| 39 | 205/160 | 13/64 | 82/90 | Em-16 |
| 40 | 550/440 | 58/115 | 70/79 | Em-20 |
| 41 | 132/105 | 26/85 | 65/72 | Em-24 |

*The ratio of the measured value for emulsion of sensitization recipe P to that for emulsion of sensitization recipe Q As is apparent from Table 7, the samples containing two types of spectral sensitizing dyes (sensitization recipe P) are better than those containing one sensitizing dye (sensitization recipe Q) in sensitivity, preservation resistance and pressure resistance. Particularly, in comparison from the viewpoint of silver halide grain structure, the tabular crystal grains according to the invention bring out the effect of the invention more remarkably than regular crystal grains (Em-1) do.

EXAMPLE 4

The sensitizing effect was examined by applying combinations of the spectral sensitizing dye of formula I and the spectral sensitizing dye of formula II' to the emulsion Em-24 prepared in Example 1.

To the emulsion heated to 60° C. was added the spectral sensitizing dyes in amounts prescribed in Table 5 in the form of dispersions of fine solid particles. Then, a mixed aqueous solution of ammonium thiocyanate, chloroauric acid and sodium thiosulfate and a methanol solution of N,N'-dimethylselenourea were added thereto and, 60 minutes later, a silver iodide fine particle emulsion was further added; thus, the emulsion was subjected to ripening over a total period of 2 hours. After completion of the ripening, a proper amount of TAI was added as a stabilizer.

The additives, other than the spectral sensitizing dyes, were added in the amounts shown below:

| | |
|---|---|
| Potassium thiocyanate | 95 mg |
| Chloroauric acid | 25 mg |
| Sodium thiosulfate | 20 mg |
| N,N'-dimethylselenourea | 4 mg |
| Silver iodide fine grains | 850 mg |
| Stabilizer TAI | 1 g |

The emulsions thus obtained were made up into coating solutions for emulsion layer by adding the additives as in Example 1. A coating solution for protective layer was also prepared as in Example 1. Sample Nos. 42 to 51 were prepared by coating and drying these coating solutions as in Example 1.

These samples were exposed and processed in the same manner as in Example 1, except that the processing was carried out for two different periods of 30 seconds and 45 seconds by the modification of the automatic processor. The processed samples were evaluated in the same manner as in Example 1, of which results are shown in Table 8.

TABLE 8

| Sample | 30-Second Processing | | 45-Second Processing | |
|---|---|---|---|---|
| No. | Fog | Sensitivity | Fog | Sensitivity |
| 42 | 0.010 | 105 | 0.012 | 118 |
| 43 | 0.010 | 123 | 0.011 | 132 |
| 44 | 0.009 | 114 | 0.011 | 125 |
| 45 | 0.011 | 114 | 0.013 | 125 |
| 46 | 0.010 | 125 | 0.011 | 137 |
| 47 | 0.009 | 118 | 0.010 | 126 |
| 48 | 0.011 | 117 | 0.012 | 128 |
| 49 | 0.009 | 130 | 0.011 | 142 |
| 50 | 0.009 | 122 | 0.011 | 135 |
| 51 | 0.009 | 77 | 0.010 | 100 |

As can be understood from Table 8, the samples sensitized by combined use of spectral sensitizing dyes are higher in sensitivity, even in a shortened processing time of 30 seconds, and less in fluctuation with processing time than sample No. 51.

What is claimed is:

1. A light-sensitive silver halide photographic emulsion comprising silver halide grains, wherein 70% or more of the total projected area of said silver halide grains is tabular grains having an average aspect ratio of a diameter to a thickness of 2 or more, each of said tabular grains containing parallel twin planes separated by at least one interplanar distance, one said interplanar distance being a longest distance, said longest distance being said interplanar distance when two twin planes are present in the grain or the longest interplanar distance when more than two twin planes are present in the grain, an average value of said longest distances being at least 0.008 μm, and a variation coefficient of the longest distances between parallel twin planes in said tabular grains is 35% or less, and wherein said silver halide emulsion is spectrally sensitized by adding a sensitizing dye, having a solubility in water of $2\times10^{-4}$ to 4 to $10^{-2}$ mol per liter of water at 27° C., to said emulsion in the form of a dispersion of solid particles in an aqueous solution substantially free from an organic solvent or surfactant, said tabular grains having an average silver iodide content of 2 mol % or less, said tabular grains comprising a core and a shell.

2. The silver halide emulsion of claim 1, wherein said silver halide emulsion is spectrally sensitized with a dye represented by formula (I) or (II), formula (I)

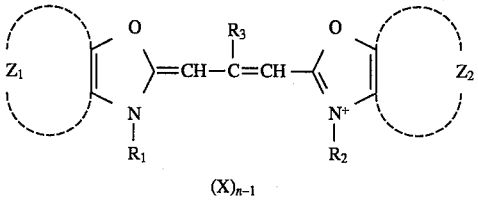

$(X)_{n-1}$ wherein $R_1$ and $R_2$ each represent an alkyl group, an alkenyl group or an aryl group, provided that at least one of $R_1$ and $R_2$ is a sulfoalkyl group or a carboxyalkyl group; $R_3$ represents a hydrogen atom, a lower alkyl group having 1 to 4 carbon atoms, or an aryl group; $Z_1$ and $Z_2$ each represent a group of nonmetallic atoms necessary to form a benzene or naphthalene ring; X represents an ion necessary to neutralize an intramolecular charge; n is an integer of 1 or 2, provided that n is 1, when an intramolecular salt is formed, formula (II)

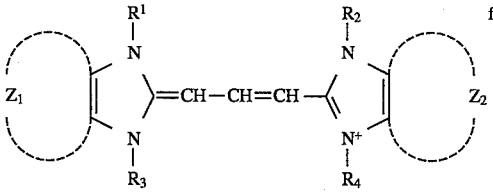

$(X)_{n-1}$ wherein $R_1$ and $R_2$ each represent an alkyl group; $R_3$ and $R_4$ each represent a lower alkyl group having 1 to 4 carbon atoms, a hydroxyalkyl group, a sulfoalkyl group or carboxyalkyl group; $Z_1$ and $Z_2$ each represent a group of nonmetallic atoms necessary to form a benzene or naphthalene ring; X represents an ion necessary to neutralize an intramolecular charge; n is an integer of 1 or 2, provided that n is 1, when an intramolecular salt is formed.

3. The silver halide emulsion of claim 1, wherein said silver halide emulsion is spectrally sensitized with a dye represented by formula (II')

formula (II')

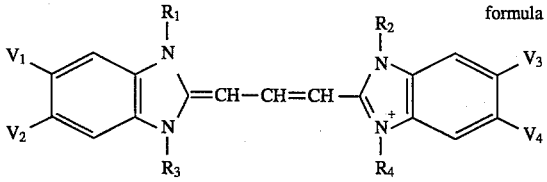

$(X)_{n-1}$ wherein $R_1$ and $R_2$ each represent an alkyl group, provided that both $R_1$ and $R_2$ are not ethyl group concurrently; $R_3$ and $R_4$ each represent a lower alkyl group, provided that at least one of $R_3$ and $R_4$ is an alkyl group having a hydrophilic group as a substituent; $V_1$, $V_2$, $V_3$ and $V_4$ each represent a hydrogen atom, a halogen atom, an alkyl group, an alkoxy group, an alkylthio group, trifluoromethyl group, cyano group, carboxy group, an alkoxycarbonyl group, an acyl group, a sulfonyl group, a carbamoyl group, a sulfamoyl group, an acetylamino group or an acetyloxy group, provided that $V_1$, $V_2$, $V_3$ and $V_4$ are not hydrogen atoms or chlorine atoms concurrently; X represents an ion necessary to neutralize an intramolecular charge; n is an integer of 1 or 2, provided that n is 1, when an intramolecular salt is formed.

4. The silver halide emulsion of claim 1, wherein said silver halide emulsion is spectrally sensitized with a combination of a dye of formula (I) and a dye of formula (II) or a combination of a dye of formula (I) and a dye of formula (II'), formula (I)

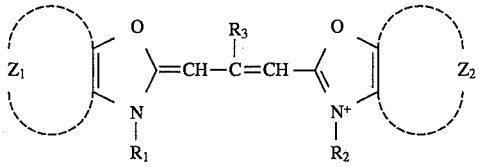

$(X)_{n-1}$ wherein $R_1$ and $R_2$ each represent an alkyl group, an alkenyl group or an aryl group, provided that at least one of $R_1$ and $R_2$ is a sulfoalkyl group or a carboxyalkyl group; $R_3$ represents a hydrogen atom, a lower alkyl group having 1 to 4 carbon atoms, or an aryl group; $Z_1$ and $Z_2$ each represent a group of nonmetallic atoms necessary to form a benzene or naphthalene ring; X represents an ion necessary to neutralize an intramolecular charge; n is an integer of 1 or 2, provided that n is 1, when an intramolecular salt is formed, formula (II)

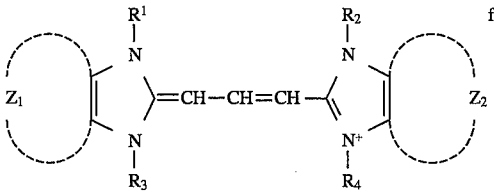

$(X)_{n-1}$ wherein $R_1$ and $R_2$ each represent an alkyl group; $R_3$ and $R_4$ each represent a lower alkyl group having 1 to 4 carbon atoms, a hydroxyalkyl group, a sulfoalkyl group or carboxyalkyl group; $Z_1$ and $Z_2$ each represent a group of nonmetallic atoms necessary to form a benzene or naphthalene ring; X represents an ion necessary to neutralize an intramolecular charge; n is an integer of 1 or 2, provided that n is 1, when an intramolecular salt is formed, formula (II')

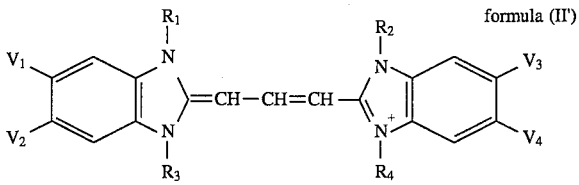

$(X)_{n-1}$ wherein $R_1$ and $R_2$ each represent an alkyl group, provided that both $R_1$ and $R_2$ are not ethyl group concurrently; $R_3$ and $R_4$ each represent a lower alkyl group having 1 to 4 carbon atoms, provided that at least one of $R_3$ and $R_4$ is an alkyl group having a hydrophilic group as a substituent; $V_1$, $V_2$, $V_3$ and $V_4$ each represent a hydrogen atom, a halogen atom, an alkyl group, an alkoxy group, an alkylthio group, trifluoromethyl group, cyano group, carboxy group, an alkoxycarbonyl group, an acyl group, a sulfonyl group, a carbamoyl group, a sulfamoyl group, an acetylamino group or an acetyloxy group, provided that $V_1$, $V_2$, $V_3$ and $V_4$ are not hydrogen atoms or chlorine atoms concurrently; X represents an ion necessary to neutralize an intramolecular charge; n is an integer of 1 or 2, provided that n is 1, when an intramolecular salt is formed.

5. The silver halide emulsion of claim 1, wherein said silver halide emulsion contains said sensitizing dye in an amount of 40 to 90% of a saturation coverage thereof.

6. The silver halide emulsion of claim 1, wherein said sensitizing dye is added to said emulsion in an amount of less than 600 mg per mol of said silver halide grains.

7. The silver halide emulsion of claim 1, wherein said emulsion is prepared by a process comprising forming seed grains, Ostwald-ripening the seed grains formed and growing the thus ripened grains, wherein at least 50% of the total projected area of said seed grains are grains having two or more parallel twin planes, each of a variation coefficient of thickness of said seed grain and a variation coefficient of the longest distances between the parallel twin planes contained in the respective seed grains being 35% or less.

* * * * *